US006708077B2

(12) United States Patent
Brower et al.

(10) Patent No.: US 6,708,077 B2
(45) Date of Patent: Mar. 16, 2004

(54) FURNACE PACING FOR MULTISTRAND MILL

(75) Inventors: Mervin W. Brower, Salem, VA (US); Alan H. Deger, Roanoke, VA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/219,332

(22) Filed: Aug. 16, 2002

(65) Prior Publication Data

US 2004/0034442 A1 Feb. 19, 2004

(51) Int. Cl.[7] ..... G06F 19/00
(52) U.S. Cl. ..... 700/149; 72/365.2; 72/10.7
(58) Field of Search ..... 700/148–153; 72/10.7, 10.3, 8.1, 11.1, 234, 221, 365.2, 366.2

(56) References Cited

U.S. PATENT DOCUMENTS

| | | | | | |
|---|---|---|---|---|---|
| 4,307,595 | A | * | 12/1981 | Nishikubo et al. | 72/234 |
| 4,457,154 | A | | 7/1984 | Ohba | 72/234 |
| 4,575,945 | A | | 3/1986 | Rigler et al. | 33/657 |
| 4,589,268 | A | * | 5/1986 | Sakurada et al. | 72/8.3 |
| 4,598,377 | A | * | 7/1986 | Takagi et al. | 700/149 |
| 5,063,767 | A | * | 11/1991 | Drummond | 72/8.8 |
| 5,174,142 | A | | 12/1992 | Pong | 72/8.6 |
| 5,404,738 | A | | 4/1995 | Sekiguchi | 72/11.4 |
| 5,461,894 | A | * | 10/1995 | Sorgel | 72/9.2 |
| 5,479,803 | A | | 1/1996 | Imanari | 72/8.6 |
| 5,495,735 | A | | 3/1996 | Nishimura | 72/8.2 |
| 5,619,880 | A | * | 4/1997 | Polster et al. | 72/11.4 |
| 5,740,686 | A | | 4/1998 | Martinetz et al. | 72/8.4 |
| 6,128,938 | A | | 10/2000 | Plociennik et al. | 72/234 |
| 6,176,112 | B1 | | 1/2001 | Sykosch et al. | 72/11.4 |
| 6,216,503 | B1 | * | 4/2001 | Kitajima et al. | 72/7.2 |
| 6,227,021 | B1 | | 5/2001 | Imanari | 72/12.3 |
| 6,240,763 | B1 | | 6/2001 | Benedetti | 72/239 |
| 2001/0015367 | A1 | | 8/2001 | Matsuo et al. | 228/5.7 |
| 2002/0078729 | A1 | | 6/2002 | Bunten | 72/241.2 |

* cited by examiner

*Primary Examiner*—Leo Picard
*Assistant Examiner*—Zoila Cabrera
(74) *Attorney, Agent, or Firm*—Hunton & Williams LLP

(57) ABSTRACT

A method and system for furnace pacing in a mill are disclosed herein. Billets are extracted from a furnace and provided in an alternating fashion to two or more strands of a multistrand stand. The timing of the extraction of each of the billets from the furnace, i.e., the furnace time, is based at least in part on a prediction of the rolling times of a previously extracted billets at the strands of the multistrand stand and a desired gap between the billets. Likewise, the actual rolling time of each billet is measured and compared with the predicted rolling time of the billet to generate a correction factor associated with the billet. The furnace time of a subsequent billet intended for a same strand as a previously extracted billet is adjusted by the correction factor associated with the previously extracted billet to regulate the gaps between billets at each strand of the multistrand stand, thereby increasing the productivity of the mill while reducing the potential for collisions between billets.

58 Claims, 4 Drawing Sheets

FURNACE PACING FOR MULTISTRAND MILL

BACKGROUND OF THE INVENTION

The present invention relates generally to rolling systems, and more particularly to pacing the extraction of billets from a furnace.

During a rolling process to roll a ductile material, such as steel, billets of the material are extracted from a furnace and typically provided to a roughing mill, such as a breakdown mill. The roughing mill generally performs an initial rolling process on the billets, reducing the cross-sectional area of the billets while simultaneously lengthening the billets. These rolled billets, or "bars," then can be provided to one or more multistrand stands in sequence, whereupon an additional rolling process is performed on the bars. The bars often are provided to a multistrand stand by alternating billets between two or more strands of the mill, allowing multiple bars to be rolled simultaneously, and thereby improving the throughput of billets.

However, due to variances in the properties of the billets, such as length, weight and/or temperature, and due to variances in the rolling system, such as slight changes in the speed of the rollers of the roughing mill and the mill, the amount of time spent rolling a billet or bar at a mill, i.e., the "rolling time," varies considerably. Unless precaution is taken in the pacing of billets from the furnace, this variance in rolling time can result in collisions between billets during the rolling operation. In the event that a collision occurs, the mill typically is shut down for a considerable period and cranes often must be used to remove the collided billets. Due to the cost of repairing the damage and the loss of productivity during the downtime, a number of mechanisms to avoid collisions between billets have been developed.

One known mechanism for minimizing the potential for collisions between billets includes extracting billets at a set sequence that introduces time gaps between the billets/rods when they are provided to the roughing mill and/or the multistrand stand. These gaps serve to compensate for variances between the properties of the extracted billets and in the rolling system itself. However, in order to effectively compensate for billets and in the rolling system itself. However, in order to effectively compensate for foreseeable variances, the gaps generally are relatively large. As a result, the productivity of a rolling system that utilizes such a mechanism is degraded since the large gaps between billets reduce the throughput of billets through the system.

Accordingly, other mechanisms have been developed to regulate the gaps between billets by regulating the timing of the extraction (i.e., the pacing) of billets from the furnace. By regulating the timing, the size of the gaps between billets can be reduced somewhat while still compensating for the variance between the rolling times of extracted billets. These known regulated pacing mechanisms typically compare a predicted rolling time of a previously extracted billet with its actual rolling time, and based on an error between the two rolling times, adjust the timing of the extraction of a subsequent billet from the furnace. However, the predicted rolling times of billets typically are fixed, being based on only fixed properties of the billets, such as a fixed or average weight and/or length, and do not take into account the variances between the properties of individual billets. The use of fixed predicted rolling times often results in gaps larger than desired or necessary, thereby decreasing productivity, or gaps smaller than desired or necessary, thereby increasing the potential for collisions between billets.

In view of the limitations of known furnace pacing implementations, an improved system and method for regulating the extraction of billets from a furnace in a rolling system would be advantageous. Specifically, a method and apparatus for calling billets from a furnace at an optimum time to achieve a minimum gap between the tail end of one billet and the head end of the next in, for instance, a breakdown mill and in each strand of a multistand stand, is needed to maximize production.

SUMMARY OF THE INVENTION

The disclosed technique mitigates or solves the above-identified limitation in known implementations, as well as other unspecified deficiencies in the known implementations.

A method and system for pacing a furnace supplying a single strand breakdown mill feeding a multistand, multistrand stand is provided. The billets are extracted from the furnace and rolled to a round bar at the breakdown mill. The rolled bar can receive a head cut and a tail cut at the breakdown mill. The rolled bar is then transported to either the first strand or the second strand of, for instance, a multistand mill. Each strand receives a bar alternatively. In one embodiment, the pacing of the extraction of billets from the furnace is regulated such that there is a regulated gap between the billets at the each of the strands of the mill. The regulated gap can be selected to provide a balance between productivity and potential for collision, and preferably is between about 5 seconds and 20 seconds in length.

In accordance with one embodiment of the present invention, a method for pacing an extraction of billets from a furnace intended for a stand having at least one strand is provided. The method comprises the steps of extracting a first billet from the furnace at a first time, the first billet being intended for a first strand of the stand and predicting a rolling time of the first billet through the first strand based at least in part on at least one measured property of the first billet. The method further comprises the step of determining a first correction value based on an equation:

$$\mathrm{Cor}_n=\mathrm{Cor}_{n-1}+(\mathrm{Measured_Time}_{Strand1}-\mathrm{Rolling_Time}_{Strand1}-\mathrm{Cor}_{n-1})*k$$

where $\mathrm{Cor}_n$ represents the first correction value, $\mathrm{Cor}_{n-1}$ represents a previous correction value used to adjust a timing of an extraction of a previously extracted billet from the furnace intended for the first strand, $\mathrm{Measured_Time}_{Strand1}$ represents a measured rolling time of the previously extracted billet at the first strand, $\mathrm{Rolling_Time}_{Strand1}$ represents a predicted rolling time of the previously extracted billet at the first strand, and k represents a real-number adjustment factor. The method additionally comprises the steps of determining a first furnace time based at least in part on the predicted rolling time of the first billet, a desired gap between billets at the first strand, and the correction value, and extracting a second billet from the furnace at a second time subsequent to the first time, the second billet being intended for the first strand, and wherein a difference between the first time and the second time is substantially equivalent to the first furnace time.

In accordance with another embodiment of the present invention, a method for regulating gaps between billets provided from a furnace to alternating strands of a multistrand stand is provided. The method comprises the steps of extracting a first billet from the furnace at a first time, the first billet being intended for a first strand of the mill, extracting a second billet from the furnace at a second time subsequent to the first time, the second billet being intended for a second strand of the mill, extracting a third billet from the furnace at a third time subsequent to the second time, the third billet being intended for the first strand, and extracting a fourth billet from the furnace at a fourth time subsequent to the third time, the fourth billet being intended for the second strand of the mill. In this embodiment, the difference between the first time and the third time is based at least in part on a predicted rolling time of the first billet at the first strand, a desired gap between billets at the first strand, and a first correction value, and the predicted rolling time of the first billet is based at least in part on at least one measured property of the first billet.

Furthermore, the first correction value is based at least in part on based on an equation:

$$Cor_n = Cor_{n-1} + (Measured_Time_{Strand} - Rolling_Time_{Strand1} - Cor_{n-1}) * k$$

where $Cor_n$ represents the first correction value, $Cor_{n-1}$ represents a previous correction value used to adjust a timing of an extraction of a previously extracted billet from the furnace intended for the first strand, $Measured_Time_{Strand1}$ represents a measured rolling time of the previously extracted billet at the first strand, $Rolling_Time_{Strand1}$ represents a predicted rolling time of the previously extracted billet at the first strand, and k represents a real-number adjustment factor.

The difference between the second time and the fourth time, in this embodiment, is based at least in part on a predicted rolling time of the second billet at the second strand, a desired gap between billets at the second strand, and a second correction value. The predicted rolling time of the second billet is based on at least one measured property of the second billet, wherein the second correction value is based on an equation:

$$Cor_n = Cor_{n-1} + (Measured_Time_{Strand1} - Rolling_Time_{Strand1} - Cor_{n-1}) * k$$

where $Cor_n$ represents the second correction value, $Cor_{n-1}$ represents a previous correction value used to adjust a timing of an extraction of a previously extracted billet from the furnace intended for the second strand, $Measured_Time_{Strand1}$ represents a measured rolling time of the previously extracted billet at the second strand, $Rolling_Time_{Strand1}$ represents a predicted rolling time of the previously extracted billet at the second strand, and k represents the real-number adjustment factor.

In a rolling system comprising a furnace for providing billets to a stand having at least one strand, an apparatus is provided in accordance with yet another embodiment of the present invention. The apparatus comprises means for obtaining measured property information representative of at least one measured property of a first billet extracted from the furnace at a first time and being intended for a first strand of the stand, means for obtaining a measured rolling time of the first billet at the first strand, and a pacing control coupled to the means for obtaining the measured property information and the means for obtaining the measured rolling time. The pacing control is adapted to predict a predicted rolling time of the first billet at the first strand based at least in part on the measured property information and determine a correction value based at least in part on an equation:

$$Cor_n = Cor_{n-1} + (Measured_Time_{Strand1} - Rolling_Time_{Strand1} - Cor_{n-1}) * k$$

where $Cor_n$ represents the correction value, $Cor_{n-1}$ represents a previous correction value used to adjust a timing of an extraction of a previously extracted billet from the furnace intended for the first strand, $Measured_Time_{Strand1}$ represents a measured rolling time of the previously extracted billet at the first strand, $Rolling_Time_{Strand1}$ represents a predicted rolling time of the previously extracted billet at the first strand, and k represents a real-number adjustment factor. The pacing control is further adapted to direct an extraction of a second billet intended for the first strand at a second time subsequent to the first time, wherein a difference between the first time and the second time is based at least in part on a sum of a predicted rolling time of the second billet, the correction value, and a desired gap between billets at the first strand.

In a rolling system comprising a furnace for providing billets to a stand having at least one strand, a computer readable medium is provided in accordance with an additional embodiment of the present invention. The computer readable medium including a set of instructions adapted to manipulate a processor to predict a predicted rolling time of a first billet at a first strand based at least in part on a measured property of the billet and determine a correction value based at least in part on an equation:

$$Cor_n = Cor_{n-1} + (Measured_Time_{Strand1} - Rolling_Time_{Strand1} - Cor_{n-1}) * k$$

where $Cor_n$ represents the correction value, $Cor_{-1}$ represents a previous correction value used to adjust a timing of an extraction of a previously extracted billet from the furnace intended for the first strand, $Measured_Time_{Strand1}$ represents a measured rolling time of the previously extracted billet at the first strand, $Rolling_Time_{Strand1}$ represents a predicted rolling time of the previously extracted billet at the first strand, and k represents a real-number adjustment factor. The computer readable medium further includes instructions adapted to manipulate the processor to direct an extraction of a second billet intended for the first strand at a second time subsequent to the first time, wherein a difference between the first time and the second time is based at least in part on a sum of a predicted rolling time of the second billet, the correction value, and a desired gap between billets at the first strand.

Still further features of various embodiments of the present invention are identified in the ensuing description, with reference to the drawings identified below.

BRIEF DESCRIPTION OF THE DRAWINGS

The purposes and advantages of various embodiments of the present invention will be apparent to those of ordinary skill in the art from the following detailed description in conjunction with the appended drawings in which like reference characters are used to indicate like elements, and in which.

DETAILED DESCRIPTION OF THE PREFERRED EMBODIMENTS

FIGS. 1–4 illustrate a system and method for increasing the productivity of a mill system having a multistand mill with two or more strands by regulating the timing of the extraction of billets from the furnace to introduce regulated gaps between billets provided to each strand of the mill. In at least one embodiment, the timing of the extraction of a billet from a furnace (i.e., the pacing) is based at least in part on a predicted rolling time of the billet at the intended strand. The predicted rolling time, in one embodiment, is predicted based on one or more measured properties of the billet, such as the measured weight, volume, temperature, and/or length of the billet. The actual rolling time of the billet is measured and compared with the predicted rolling time. Based at least in part on this comparison, a correction value is determined and the timing of the next billet extracted from the furnace for the same strand is adjusted based on the correction value. This process can be repeated for subsequent billets extracted for rolling by the same strand.

Although certain embodiments of the present invention may be implemented in rolling operations on any of a variety of ductile materials, such as copper, steel, iron, and the like, other embodiments of the present invention finds particular benefit in steel rolling processes utilized to produce long products, such as rods, bars, beams, and the like. Accordingly, FIGS. 1–4 illustrate an exemplary implementation of the present invention utilized in the rolling of steel bars. While such an exemplary implementation for rolling steel long products is illustrated herein, those skilled in the art can develop methods for regulating the pacing of mills for any of a variety of ductile materials using the guidelines provided herein.

Figure 1:
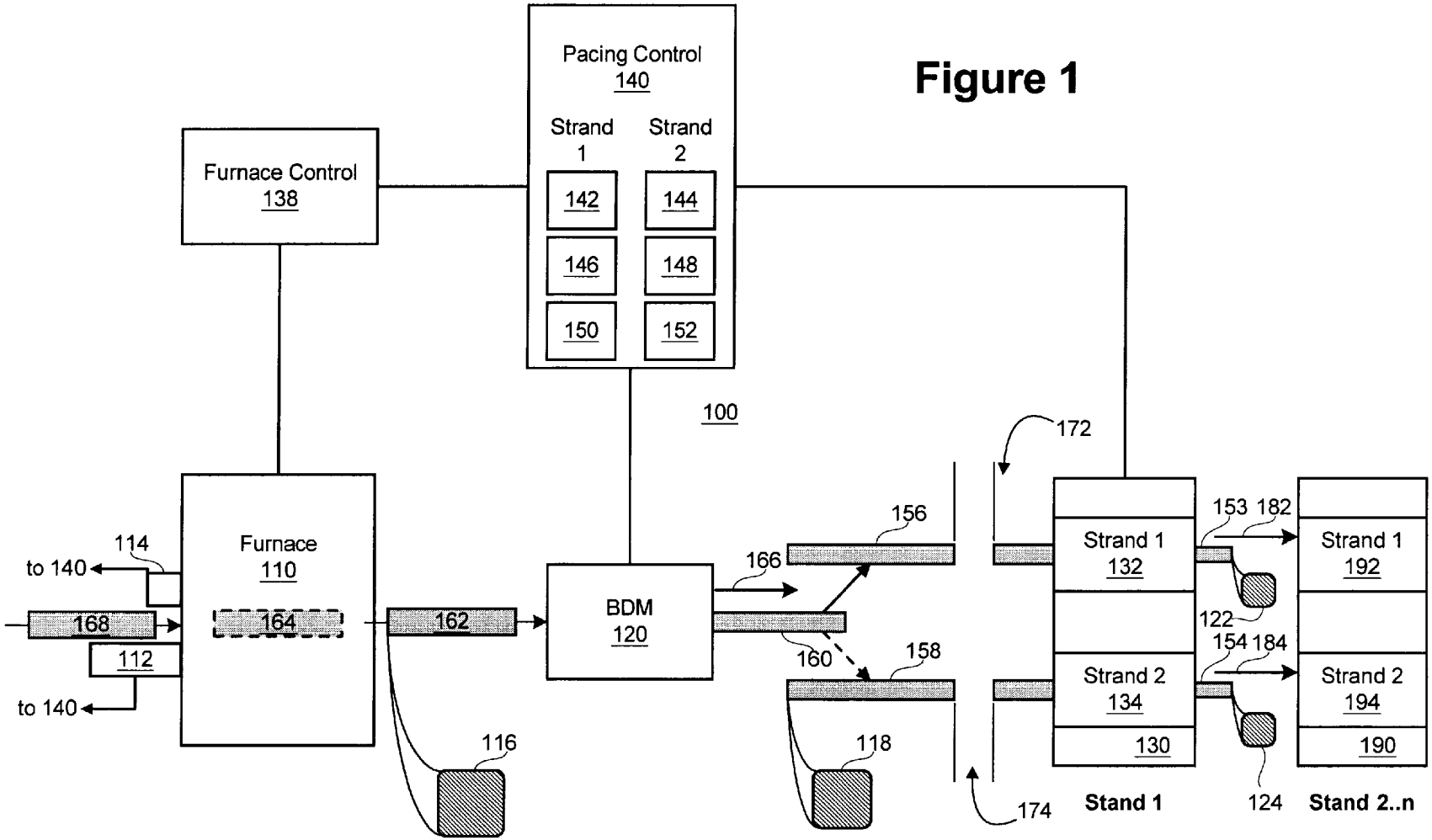
FIG. 1 is a block diagram illustrating a mill rolling system having a regulated mill pacing based in part on measured properties of extracted billets in accordance with at least one embodiment of the present invention.

Referring now to FIG. 1, an exemplary system 100 for rolling steel bar at a regulated pace is illustrated in accordance with at least one embodiment of the present invention. In the illustrated embodiment, the system 100 includes a furnace 110, a roughing mill, such as a breakdown mill (BDM) 120, and a multistrand stand 130 having at least a first strand 132 and a second strand 134. Although multistrand stand 130 is illustrated as having two strands, those skilled in the art may adapt the present invention to adjust the pacing in milling systems having more than two strands. The system 100, in at least one embodiment, further includes one or more additional stands subsequent to the stand 130 (stands 2 . . . n), such as stand 190 having a first strand 192 and a second strand 194.

In at least one embodiment, the system 100 includes a furnace control 138 adapted to control furnace tracking and billet transport in the furnace 110 and a pacing control 140 adapted to control one or more operations of the system 100 to regulate the pacing of billets through the system 100. The pacing control 140 and the furnace control 138 can be implemented in software, hardware, firmware, or a combination thereof. For example, in one embodiment, the pacing control 140 includes a programmable logic controller (PLC) adapted to control the operation of the furnace 110. Alternatively, the pacing control 140 could include a desktop computer adapted to control one or more operations of the system 100.

Although the furnace control 138 and the pacing control 140 are illustrated as separate components, in at least one embodiment, the furnace control 138 and the pacing control 140 are implemented as a single integrated component. Furthermore, although certain functions or processes are discussed herein in the context of either the furnace control 138 or the pacing control 140, such associations are exemplary only and are not intended to limit the present invention to any such arrangement. To illustrate, in one embodiment the furnace control 138, in is adapted calculate the volume of the billet from received weight and length measurements and to provide a representation of the calculated volume to the pacing control 140 for use in furnace pacing control, while in other embodiments the furnace control 138 is adapted to provide the measurements to the pacing control 140 which then calculates the billet volume from the provided values.

In at least one embodiment, heated steel billets (also known as blooms), such as billets 162, 164, and 168 are extracted from the furnace 110 and provided to the BDM 120, whereupon the billets are reduced and rolled into bars, such as bars 156–160. The bars from the BDM 120 then are provided to the multistrand stand 130, alternating between the first strand 132 and the second strand 134. The first strand 132 and the second strand 134 further reduce and roll the bars, producing either a finished product, such as rod, bar, or beam, or an intermediary product that can be provided to additional stands, such as a finishing stand (one embodiment of stand 190), for further rolling. In the illustrated embodiment, the strands 132, 134 of the multistrand stand 130 produce bars, such as bars 153, 154, from the bars provided by the BDM 120. It will be appreciated that the BDM 120 preferably rolls the billets into bars at a rate that is at least twice the rate of the strands 132, 134 in order to feed alternatively the strands 132, 134 at their optimal rate.

The following convention is used herein regarding the reference of the steel from the furnace 110 as it is processed by the exemplary system 100: "billets" are provided to the BDM 120, which renders the billets into "bars," which are then further rolled by the multistrand stand 130. Accordingly, it will be appreciated that bars are also billets, albeit having different dimensions. Although the exemplary implementation disclosed herein is directed to a mill system having a two strand stand, those skilled in the art can develop mechanisms to regulate the pacing of billets in rolling systems with stands having more than two strands using the guidelines provided herein. Additionally, although FIG. 1 represents an exemplary embodiment wherein billets are provided to the BDM 120 before being provided to alternating strands of the multistrand stand 130, in other embodiments, the extracted billets are provided directly to the multistrand stand 130.

In order to maximize the productivity of the system 100, the pacing (i.e., timing) of the extraction of billets from the furnace 110 is regulated to conform the gaps 172, 174 between billets (in the form of bars) provided to the strands 132, 134 to a desired or ideal gap. In at least one embodiment, the desired gap is selected to maximize the throughput of billets through the system 100 while allowing for variations and perturbations in the operation of the system 100 to prevent collisions. To illustrate, while a gap of 0 seconds (i.e., no gap) would maximize the throughput of the system 100, any mistiming or variation in the system 100 could cause two or more billets to collide, likely causing a shut down of the system 100 as well as a number of other difficulties, as discussed above. Conversely, setting the desired gap to a relatively large value, while effectively eliminating any potential for a collision between billets, would hamper the productivity of the system. The desired gap that provides a desired balance between preventing collisions and maximizing billet throughput can be determined empirically, through calculation, by experimentation, and the like.

To regulate the gaps 172, 174, in one embodiment, the pacing control 140 monitors the operation of the system 100 and directs the pacing of the extraction of billets from the furnace 110 (via the furnace control 138) based on a comparison of the actual values of the gaps 172, 174 with the desired gap values. When there is an error between the actual gap value and the desired gap value for a previously extracted billet, the pacing control 140 modifies the timing of the extraction of the next billet to compensate for the error.

It will be appreciated that depending on the properties of the system 100, such as the speed of the mills 120, 130, and/or the distance between the furnace 110, the BDM 120, and the multistrand stand 130, the number of billets being rolled at any given time can vary. For example, if the distances between the components of the system 100 are relatively short, then a billet extracted from the furnace 110 could be the next billet to enter one of the strands 132, 134. Alternatively, if the distance between the furnace 110, the BDM 120, and/or the multistrand stand 130 is relatively long (for instance, there could be additional processes between them), there could be multiple billets between a recently extracted billet and the destination strand of the multistrand stand 130. Accordingly, reference to a "previously extracted billet" intended for the same strand as another billet is relative to the properties of the system 100. In embodiments wherein an extracted billet (the "current billet") is the next billet to enter a strand, the "previously extracted billet" relative to the current billet is the most recently extracted billet intended for the same strand as the current billet. In embodiments wherein there are a number of billets intended for the same strand between the furnace 110 and the strand, the "previously extracted billet" relative to the current billet can be either the most recently extracted billet intended for the same strand or the billet most recently rolled by the same strand. However, as all extracted billets, in one embodiment, are rolled by the same BDM 120, in the context of detecting a potential collision at the BDM 120, the "previously extracted billet" to the current billet is the most recently extracted billet from the furnace, regardless of the intended strand of the multistrand stand 130. To clarify the relation between a "previously extracted billet" and a "current" billet or "extracted billet", consider the following example. From the perspective of the first strand 132, the previously extracted billet of the bar 156 (the "current billet" intended for the first strand 132) is bar 153, since it was supplied to the first strand 132 prior to the bar 156. However, from the perspective of the BDM 120, any of the bars 156–160 or the bars 153, 154 may be considered as "previously extracted" billets to the extracted or current billet 162.

In at least one embodiment, the pacing control 140 regulates the size of the gaps 172, 174 by regulating the timing of the extraction of the billets from the furnace 110. The regulation of the timing of the extraction of billets (i.e., pacing), in one embodiment, is based at least in part on a prediction of the time (herein referred to as the "predicted rolling time") needed for the multistrand stand 130 to roll each billet in one of strands 132, 134 adjusted by an error or difference between the predicted rolling time of a previously extracted billet and the actual or measured time (herein referred to as the "measured rolling time") utilized by the same strand to roll the previously extracted billet. The error between the predicted rolling time and the measured rolling time is used by the pacing control 140 to modify the timing of the extraction of a subsequent billet from the furnace 110 that is intended for the same strand. In effect, the pacing control 140 can utilize closed-loop feedback control to self-adjust the size of the gaps 172, 174.

As discussed above, known mechanisms for regulating the gaps between billets as they move through a rolling system estimate the rolling time of the corresponding strand of the multistrand stand 130 by using a fixed rolling time or calculating a rolling time based on a fixed or average property, such as a fixed weight or length of a theoretical billet. However, it will be appreciated that there often is considerable variation in the lengths and/or the weights of billets extracted from the furnace. Due to these variations, the fixed rolling time typically is relatively inaccurate, necessitating a relatively large gap between billets and thereby decreasing the throughput of the rolling system. However, unlike known furnace pacing systems, at least one implementation of the present invention utilizes measured properties of individual billets rather than fixed values to predict the rolling time of the billets. The predicted rolling times using measured properties typically are more accurate than predictions made using fixed values. This increased accuracy in the predicted rolling time allows the pacing control 140 to implement smaller gaps between the billets than in known furnace pacing systems using fixed billet properties. Since smaller gaps between billets results in less time between the rolling of billets than larger gaps, rolling systems implementing various embodiments of the present invention typically exhibit an increased productivity compared to known mechanisms for furnace pacing. At the same time, because the relatively smaller gaps are based in part on the measured properties of the extracted billets, the potential for a collision between billets is reduced.

Any of a variety of mechanisms may be utilized to measure one or more properties of billets extracted from the furnace 110. In one embodiment, a weight scale 112 is adapted to measure the weight of a billet prior to entering the furnace 110 and to provide a signal representative of the weight of the billet to the pacing control 140 and/or the furnace control 138. Using the measured weight of the billet, in conjunction with a known density of the steel of the billet, the pacing control 140 can calculate the volume of the billet. For example, assume the billet 162 is extracted from the furnace 110 after being heated and the weight scale 112 determines the weight of the billet 162 as 10000 kg prior to entry to the furnace 110. Also assume that the density of the steel of the billet 162 as it exits the furnace 110 is known to the pacing control 140 as 7850 kg/m$^3$ at the exit temperature of the billet. In this case, the pacing control 140 can calculate the volume of the billet 162 as approximately 1.274 m$^3$ (10000 kg/7850 kg/m$^3$).

It will be appreciated that the weight scale 112 may be placed at the entrance or the exit of the furnace or within the furnace to determine the weight of a billet either before entering the furnace 110 or after exiting the furnace. However, weight measurements are typically measured at the entry to the furnace 110 for use in temperature control of the furnace 110 by the furnace control 138. To compensate for temperature expansion of a billet in the furnace 110, in one embodiment, the length of a "hot" billet as it exits the furnace 110 is calculated from the "cold" volume of the billet using the equation:

$$\text{Billet_Volume}_{hot} = \text{Billet_Volume}_{cold} \times \left[1 + \left(C_1 \times \left[\frac{TEMP - C_4}{C_2}\right] + C_3 \times \left[\frac{TEMP - C_4}{C_2}\right]^2\right)\right] \quad \text{EQ. 1}$$

where Billet_Volume$_{hot}$ represents the volume of the billet from the furnace 110, Billet_Volume$_{cold}$ represents the volume of the billet prior to entering the furnace 110 (determined, for example, from the measured weight and a known density at the "cold" billet temperature), TEMP is the billet temperature in degrees Fahrenheit as discharged from the furnace, and $C_1$–$C_4$ represent constant-value temperature expansion adjustment factors dependent on the material being rolled. For example, for structural carbon steel, $C_1$ preferably is about 0.00675, $C_2$ is preferably about 1000, $C_3$ preferably is about 0.001636, and $C_4$ preferably is about 32.

Alternatively, in one embodiment, the volume of a billet is determined from the length of the billet as measured by a dimension measuring device 114. For example, the dimension measuring device 114 could include a photo switch located at the entrance of the furnace 110 that detects the billet as the billet passes by the photo sensor. In this case, the photo switch could send a first signal to the furnace control 138 and/or the pacing control 140 when the head of the billet is detected by the photo switch and a second signal when the tail of the billet passes. In this case, the second signal to the furnace control 138/pacing control 140 could include a termination of the first signal. Based on the time period between the first and second signal and a known speed of the conveyance mechanism used to convey the billet from to the furnace 110, the length of the billet can be calculated. For example, if it takes three seconds for a billet to pass underneath the heat sensor and the billet is moving to the furnace 110 at a rate of five meters per second, then the length of the billet can be calculated as fifteen meters (3 s*5 m/s).

The length of the billet preferably is measured at the entry to the furnace 110 because the furnace control 138 typically is adapted to use this information to center the billets. Using the previous equation (EQ. 1), the length of a "hot" billet extracted from the furnace 110 (adjusted for temperature expansion) can be calculated from the length of the billet as it enters the furnace 110. Although the length of the billet preferably is determined at the entrance to the furnace 110, in alternate embodiments, the billet length can be determined at the exit of the furnace 110. However, in order to do so using HMDs, the billet typically must exit the furnace 110 at a constant pace, which is rarely the case.

The dimension measuring device 114 can include any of a variety of other switches or sensors, such as a contact switch, imaging device, or laser emitter and detector, etc., that can be adapted to measure the length of the billet and provide the length information to the furnace control 138/pacing control 140. Alternatively, the lengths of billets can be measured and input by an operator. After the length of the billet has been determined, the volume of the billet can be calculated by multiplying the measured length by the cross-sectional area of the billet, such as the cross-sectional area 116 of billet 162. For example, if the billet 162 is measured by the dimension measuring device 114 to be 10 meters long and the cross-sectional area 116 is a constant (or average) 0.250 $m^2$, then the volume of the billet can be calculated as 2.5 $m^3$ (10 m*0.250 $m^2$). Rather than, or in addition to, measuring the length and/or weight of a billet, other dimensions may be measured as well. Other mechanisms to measure one or more dimensional properties of a billet may be utilized without departing from the spirit or the scope of the present invention.

It will be appreciated that most metals, and especially steel, are relatively incompressible. Accordingly, the volume of the billet input to a stand is substantially the same as the volume of the bar output from the stand assuming no modification of the bar is performed (e.g., a head cut or a tail cut), the volume of the billet entering a rolling mill, such as the BDM 120 or the multistrand stand 130, is substantially the same as the volume of the resulting product output from the mill/stand. Accordingly, in one embodiment, the pacing control 140 predicts the predicted rolling time of a billet/bar in one of strands 132, 134 of the multistrand stand 130 based at least in part on the volume of the billet/bar and the output volume rate of the strand, where the volume of the billet is determined either from measured properties of the "hot" billet extracted from the furnace 110 or the "cold" billet prior to entry to the furnace 110 (with compensation for temperature expansion using, in one embodiment, EQ. 1).

To illustrate, bars output from strand 132 of the multistrand stand 130 have a cross-sectional area 122 and an exit speed 182. The resulting output volume rate of the first strand 132 can be calculated as a product of the exit speed 182 and the cross-sectional area 122. Since, in at least one embodiment, the volume of a billet/rod input to the first strand 132 is measured prior to entry of the billet into the furnace 110, the predicted rolling time of the billet/rod at the first strand 132 can be calculated using the equation:

$$\text{Rolling_Time}_{Strand1} = \frac{BilletVolume}{\text{STD1_Area} \times \text{STD1_Speed}} \qquad \text{EQ. 2}$$

where $\text{Rolling_Time}_{Strand1}$ represents the predicted rolling time of a billet/rod at the first strand 132, BilletVolume represents the volume of the "hot" billet calculated from measured properties of the billet (after accounting for temperature expansion, if any), STD1_Area represents the cross-sectional area 122 of the bar output from the first strand 132 and STD1_Speed represents the exit speed 182 of the bar from the first strand 132. The rolling time for a billet/rod at the second strand 134 can be predicted in the same manner using the cross-sectional area 124 of the bar exiting the second strand 134 and the exit speed 184 of the bar from the second strand 134. In at least one embodiment, the cross-sectional areas 122 and 124 are substantially equivalent, as are the exit speeds 182, 184.

The exit speeds 182 and 184 can be measured, for example, using a stand motor tachometer that measures the rotational speed of the roll of the corresponding strand. Using the rotational speed and the effective diameter of the roll, the linear speed of the strand can be determined. It will be appreciated that inaccuracy in the effective diameter and/or the rotational speed of the roll can be some of the variables that affect the gap time. Alternatively, in another embodiment, the exit speeds 182 and/or 184 are known and fixed, either from a previous measurement of the exit speeds 182, 184 or from a calculation of the exit speeds based on the properties of billets/bars processed by the strands 132, 134 of the multistrand stand 130.

Since the head and tail of a bar rolled by the BDM 120 may have a cross-sectional area and/or shape that is inconsistent with the remainder of the bar, a head cut and/or tail cut often are performed to create a bar having a substantially uniform cross-sectional area and/or shape. Accordingly, in at least one embodiment, the BDM 120 performs a head cut and/or a tail cut on a bar before the bar is provided to the multistrand stand 130, thereby reducing the mass and volume of the bar provided to the multistrand stand 130. Head and tail cuts often are implemented to square up the bar so it will not cobble going into the next stand, prevent underfill or overfill in the stand, and to minimize head/tail scrap removal further downstream. In the event that a head cut and/or tail cut is performed, the value of BilletVolume can be calculated as:

$$\text{BilletVolume} = \text{BilletVolume}_{Furnace} - \text{BDM_Area} * (\text{Headcut} + \text{Tailcut}) \qquad \text{EQ. 3}$$

where BilletVolume, in this case, represents the volume of the bar produced by the BDM 120, $\text{BilletVolume}_{Furnace}$ represents the volume of the billet after extraction from the furnace 110, BDM_Area represents the cross-sectional area 118 of the resulting bar as it is output from the BDM 120, Headcut represents the length of the head cut, measured longitudinally, performed by the BDM 120, and Tailcut represents the length of the tail cut, measured longitudinally, performed by the BDM 120. It will be appreciated that if no head cut or tail cut is performed (i.e., Headcut and Tailcut=0), then the above equation reduces to BilletVolume=$BilletVolume_{Furnace}$, and thus the value of BilletVolume for the resulting bar is the volume of the corresponding billet as measured at the output of the furnace 110. Also, the volume of the billet may be measured and calculated after a head cut and/or tail cut is performed. In a similar manner, the predicted rolling time of a billet at the BDM 120 can be calculated based in part on the exit speed 166 of bars from the BDM 120, as described in greater detail below.

As noted above, the pacing control 140 regulates the pacing of the extraction of billets from the furnace 110 based at least in part on a comparison of the predicted rolling time of a billet at one of strands 132, 134 with the measured rolling time of a previously extracted billet at the strand. The measured rolling time, herein referred to as $Measured_Time_{Strand1}$ for the first strand 132 and as $Measured_Time_{Strand2}$ for the second strand 134, in one embodiment, is measured from the time when the head of a bar exits the strand and when the tail of the bar exits the strand. Similarly, in one embodiment, the time between the entry of the head of a billet into the BDM 120 and the exit of the tail of the resulting bar from one of the strands 132, 134 is measured. This time between the BDM 120 and a strand is referred to as $Measured_Time_{BDM_Strand1}$ for the first strand 132 and as $Measured_Time_{BDM_Strand2}$ for the second strand 134. $Measured_Time_{BDM_Strand1}$ and $Measured_Time_{BDM_Strand2}$, in one embodiment, are used to prevent potential collisions between billets along the system 100, as discussed in detail below.

Based at least in part on the predicted rolling time of billets intended for one of strands 132, 134, the pacing control 140 determines the appropriate time to extract the next billet destined for the same strand, herein referred to as the "furnace time" for the strand. Meanwhile, the pacing control 140 compares the measured rolling time of a previously extracted billet provided to the same strand with the predicted rolling time of the previously extracted billet. Based on this comparison, a correction value can be determined and the pacing control 140 can adjust the furnace time of the next billet intended for the same strand by the correction value. By adjusting the timing of the extraction of billets intended for a certain strand from the furnace 110 by the error between the predicted and measured rolling times of the previously extracted billet provided to the certain strand, the pacing control 140 can more closely regulate the gap between billets provided to the strands 132, 134 of the multistrand stand 130. Mechanisms to determine the correction value and to adjust the timing value accordingly are discussed in detail with reference to FIGS. 3 and 4.

In at least one embodiment, the pacing control 140 maintains furnace timers 142, 144 to control the timing of the extraction of billets from the furnace, where the furnace timer 142 is utilized to time the extraction of billets intended for the first strand 132 and the furnace timer 144 is utilized to time the extraction of billets intended for the second strand 134. Each of furnace timers 142, 144 is provided with an initial furnace time, herein referred to as $Furnace_Time_{Strand1}$ for furnace timer 142 and $Furnace_Time_{Strand2}$ for furnace timer 144, and the each furnace timer is started when a billet is extracted from the furnace 110 for the corresponding strand. Each of the furnace timers 142, 144 count down until the remaining time on the timer is equivalent to zero (i.e., the furnace time has expired). The remaining times on furnace timers 142, 144 are referred to as $Furnace_Timer_{Strand1}$ for furnace timer 142 and $Furnace_Timer_{Strand2}$ for furnace timer 144. For example, if a the furnace timer 142 were initiated with a furnace time of ten seconds ($Furnace_Time_{Strand1}$=10 s) and started at time $t_0$, then the value of the furnace timer 142 four seconds later ($t_0$+4) would be 6 seconds ($Furnace_Timer_{Strand1}$=6). Of course, either an incremental process or a decremental process is appropriate and well known, and either may be implemented accordingly.

When the remaining time for one of the furnace timers 142, 144 has expired (Furnace_Timer=0), the pacing control 140 directs the furnace 110 (through the furnace control 138) to extract a billet for the strand associated with the expired furnace timer and to provide the billet to the BDM 120 for rolling. After the billet is extracted and one or more properties of the billet are obtained by the pacing control 140 from the furnace control 138, the pacing control 140 determines the next initial furnace time for the corresponding timer based at least in part on the predicted rolling time of the extracted billet and a correction value that is based on the error between the measured and predicted rolling time of a previously extracted billet for the intended strand.

Additionally, in one embodiment, the pacing control 140 maintains one or more timers for each billet extracted from the furnace. These timers can include a strand rolling timer 146 for each billet extracted for the first strand 132 and a strand rolling timer 148 for each billet extracted for the second strand 134. The strand rolling timers 146, 148 can be adapted to obtain a measurement of the actual rolling time of a billet in the corresponding strand of the multistrand stand 130. In other words, strand rolling timers 146, 148 are used to determine and/or store $Measured_Time_{Strand1}$ and $Measured_Time_{Strand2}$, respectively. The timers of the pacing control 140 can also include a BDM rolling timer 150 for billets extracted for the first strand 132 and a BDM rolling timer 152 for billets extracted for the second strand 134. The BDM rolling timers 150, 152 can be used to determine and/or store $Measured_Time_{BDM_Strand1}$ and $Measured_Time_{BDM_Strand2}$, respectively. The values of these timers then can be used to adjust the furnace time of the next billet for a corresponding strand, ascertain the potential for a collision between billets, and the like.

The timers 142–152 can be implemented in any of a variety of ways, including software, hardware, firmware, or a combination therein. In one embodiment, some or all of the timers 142–152 are adapted to operate in a manner similar to a stopwatch, wherein a start signal and a stop signal are received, and the time that elapsed between the start and stop signals represents the elapsed time. Alternatively, in one embodiment, some or all of the timers 142–152 can include two or more time entries wherein the start time is stored in one entry and the stop time is stored in another entry. The pacing control 140 can calculate the elapsed time represented by the timer as the difference between the stop time and the start time. While two exemplary implementations of the timers 142–152 have been illustrated, any mechanism for implementing timers may be used without departing from the spirit or the scope of the present invention.

Although the pacing control 140 preferably is adapted to control the pacing of billets from the furnace, in other embodiments, the pacing control 140 (or other suitable device) can be adapted to regulate one or more other operations of the rolling system 100 without departing from the spirit or the scope of the present invention. For example, the pacing control 140 can be adapted to change the speed of the conveyance mechanisms between the furnace 110, the BDM 120, and the stand 130 based on the variance between the actual gaps between billets and the ideal gap. For example, if the actual gaps between billets at the stand 130 are too large, the pacing control 140 could be adapted to increase the speed of the billet conveyor (not shown) between the BDM 120 and the stand 130. Likewise, if the actual gaps are too small, the billet conveyor can be slowed down. Similarly, the pacing control 140 could be adapted to control the rate at which material is fed into the furnace 110 based on comparisons between actual and predicted rolling times of billets.

Figure 2:
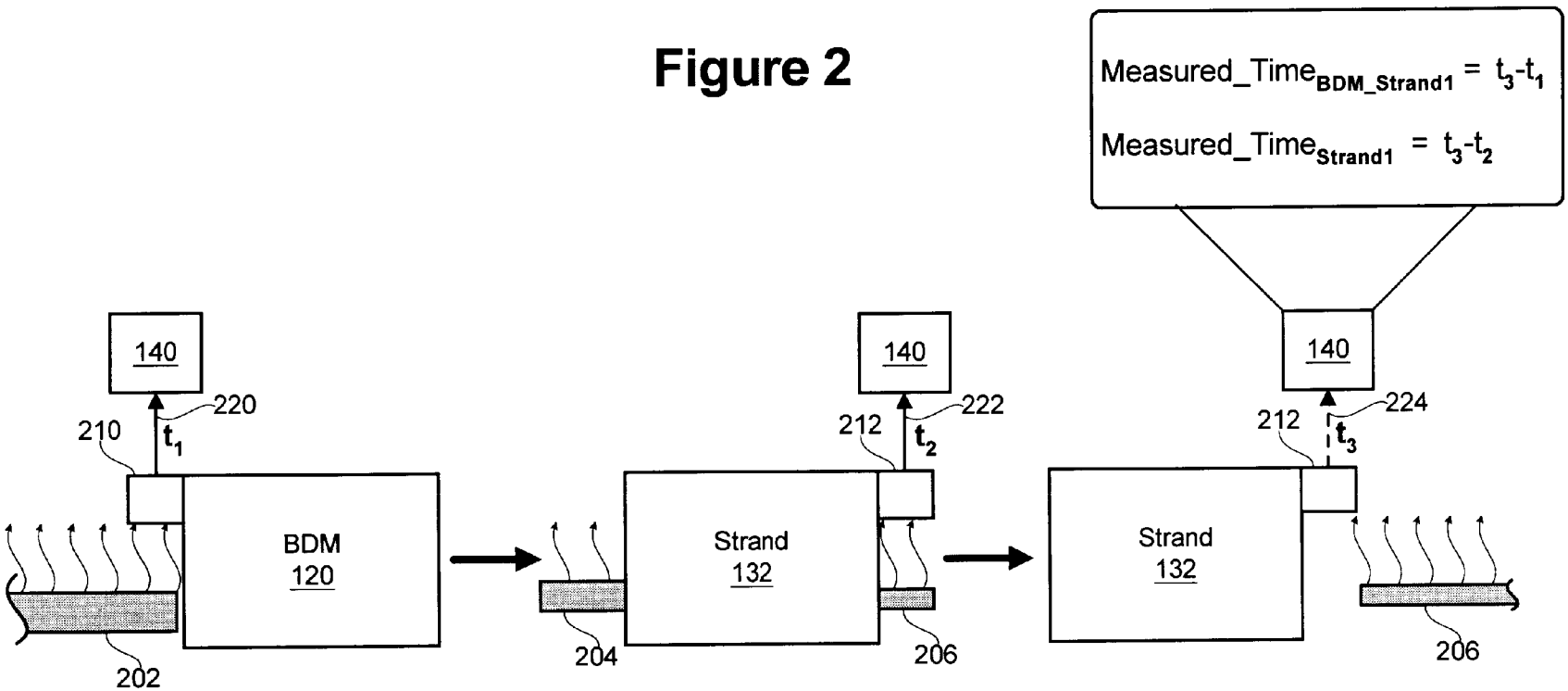
FIG. 2 is a block diagram illustrating a mechanism for measuring various rolling times in accordance with at least one embodiment of the present invention.

Referring now to FIG. 2, an exemplary mechanism for measuring various rolling times is illustrated in accordance with at least one embodiment of the present invention. As noted above, in at least one embodiment, the rolling time of a billet within a strand of the multistrand stand 130 is measured, as is the rolling time between the entrance of the head of the billet into the BDM 120 and the exit of the head of the billet from the strand. Any of a variety of mechanisms may be implemented to measure these rolling times, one of which is illustrated in FIG. 2.

In the illustrated embodiment, a hot metal detector (HMD) 210 is located at the entry of the BDM 120 and a HMD 212 is located at the exit of the first strand 132. As the head of billet 202 approaches the entry of the HMD 210, the HMD 210 detects the heat emitted by the billet 202 and sends a signal 220 to the pacing control 140 at time $t_1$. The pacing control 140, noting the signal 220 received at time $t_1$, stores a value representing time $t_1$ in the BDM rolling timer 150. The BDM 120 rolls the billet 202 into bar 204 and provides the bar 204 to the first strand 132. The first strand 132 rolls the billet/bar further into a bar 206, and as the head of the bar 206 emerges from the exit of the first strand 132, the HMD 212 detects the heat emitted by the bar 206 and provides a signal 222 at time $t_2$ to the pacing control 140, thereby indicating the emergence of the head of the bar 206 from the first strand 132. The pacing control 140, noting the receipt of the signal 222 at time $t_2$, stores a value representing time $t_2$ in the strand rolling timer 146 associated with the billet 202. As the bar/rod continues to pass through the first strand 132, the HMD 212 continues to provide signal 222 to the pacing control 140, indicating the continued presence of the bar 206 at the exit of the first strand 132. However, once the tail of the bar 206 exits the first strand 132 and passes the HMD 212, the HMD 212 ceases to detect heat and stops transmitting signal 222 to the pacing control 140 at time $t_3$. The pacing control 140, noting the cessation of the signal 222 (the cessation of the signal 222 being representative of the transmission of a signal 224 at time $t_3$), determines that the billet 202/rod 206 has exited the first strand 132 and stores a value representing time $t_3$ in both the BDM rolling timer 150 and the strand rolling timer 146.

Using the values representing times $t_1$, $t_2$, and/or $t_3$ stored in the BDM rolling timer 150 and the strand rolling timer 146, the pacing control 140 can determine the value of Measured_Time$_{Strand1}$ for billet 202 as the elapsed time between times $t_2$ and $t_3$. The value of Measured_Time$_{BDM_Strand1}$ for billet 202 can be calculated by the pacing control 140 as the elapsed time between times $t_1$ and $t_3$. In a similar manner, the actual rolling times represented by Measured_Time$_{Strand2}$ and Measured Time$_{BDM_Strand2}$ for the second strand 134 can be measured.

In addition to, or rather than, using HMDs 210, 212, other detection/timing equipment can be utilized to measure the status of billets within the rolling system. For example, sensing equipment, such as an HMD, can be placed at the exit of the furnace 110, at the exit of the BDM 120, and the like, and using these sensors, the pacing control 140 can determine whether the billets are being milled as predicted. For example, the pacing control 140 could predict a certain time that a head of a billet should emerge from the BDM 120, and using an HMD at the exit of the BDM 120, the pacing control 140 can determine the actual time of emergence of the head of the billet. Comparing the actual emergence time and the predicted emergence time, the pacing control 140 can alter one or more operations of the rolling system to more accurately synchronize the rolling system. Although an exemplary mechanism for measuring various rolling times has been illustrated with reference to FIG. 2, other mechanisms may be implemented without departing from the spirit or the scope of the present invention.

Figure 3:
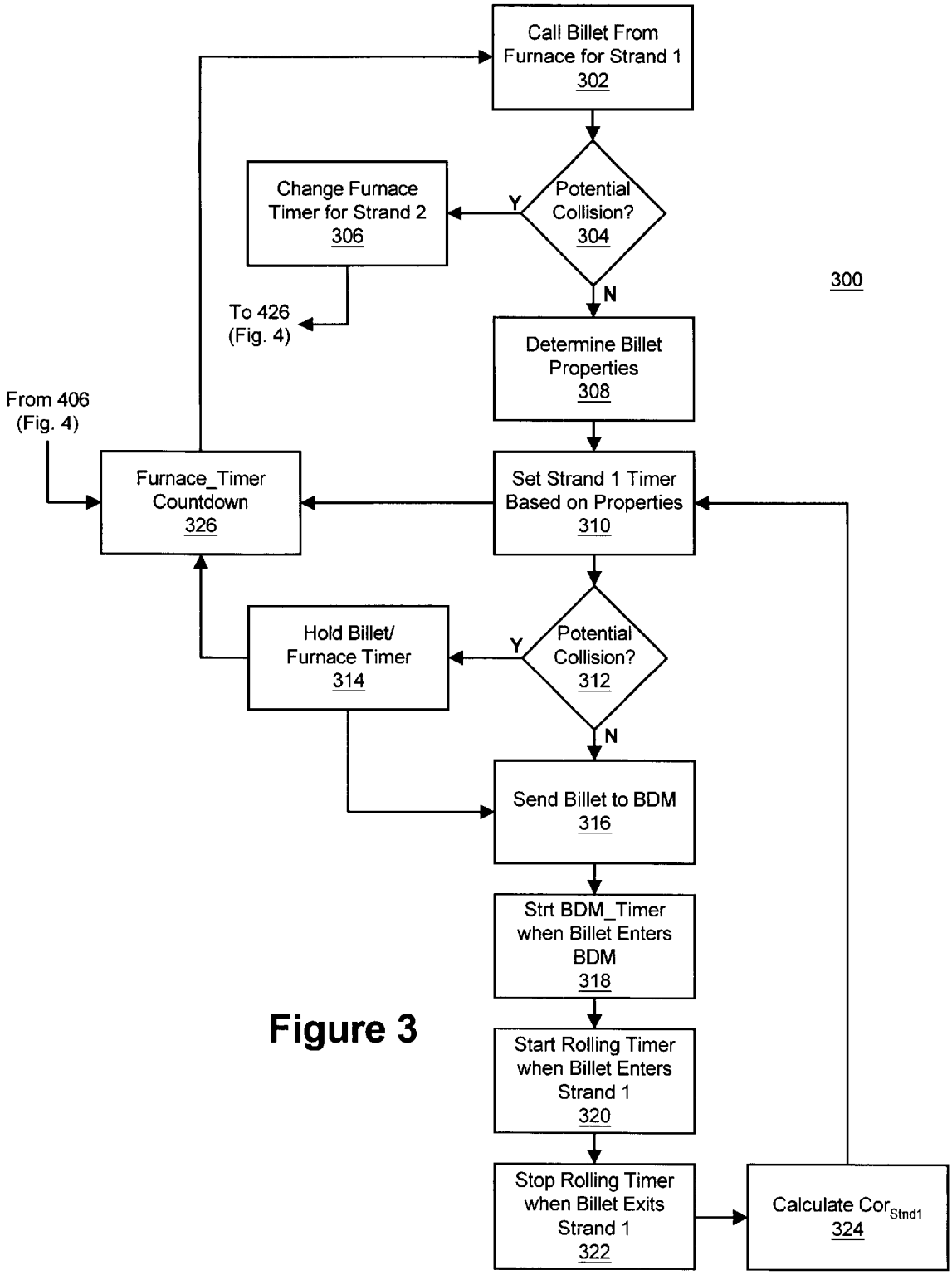
FIGS. 3 and 4 are flow diagrams illustrating mechanisms for regulating the extraction of billets from a furnace based at least in part on measured properties of the billets in accordance with at least one embodiment of the present invention.
Figure 4:
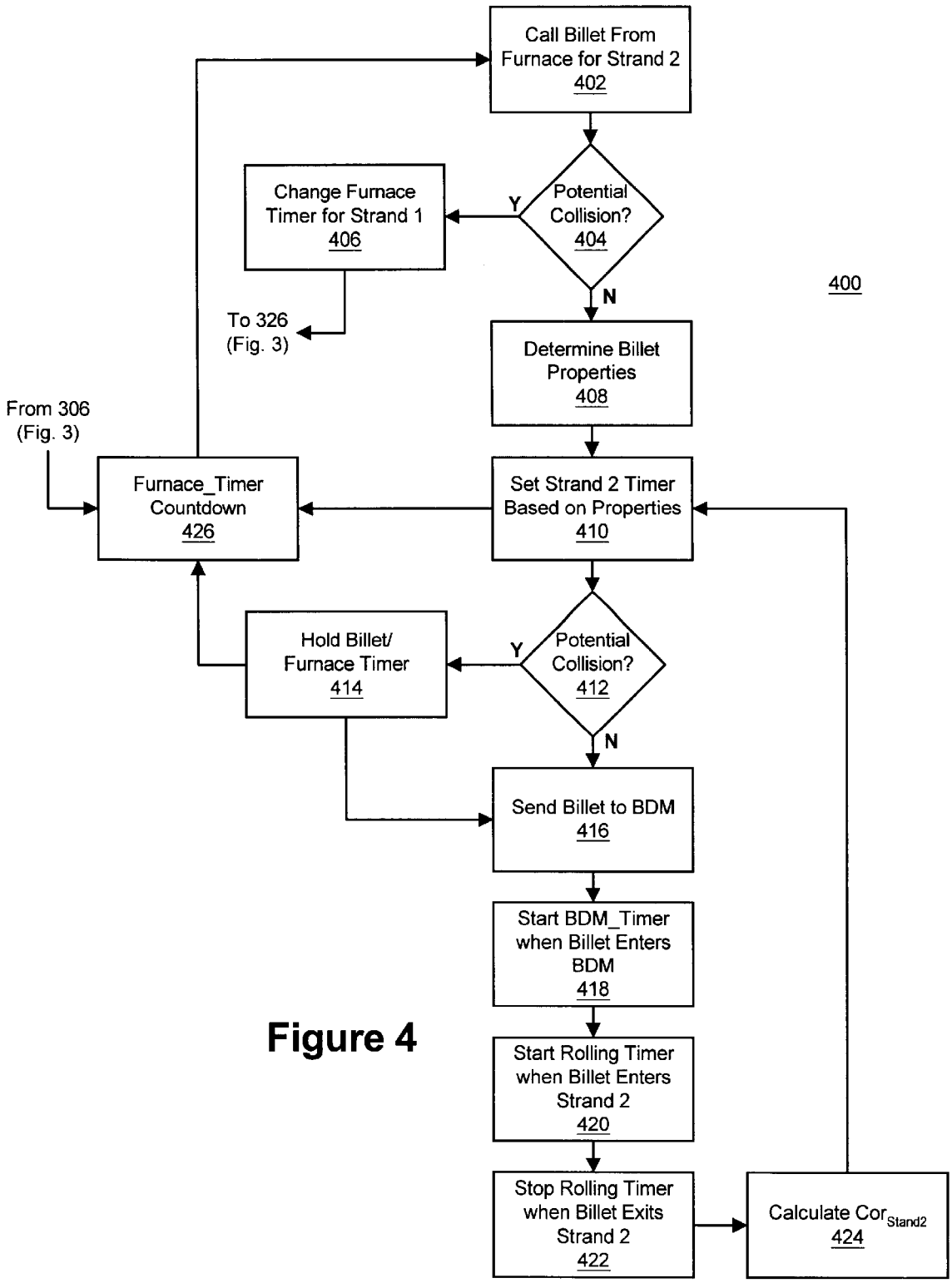

Referring now to FIGS. 3 and 4, an exemplary algorithm implemented by the pacing control 140 to regulate the pacing of the extraction of billets from the furnace 110 is illustrated. The exemplary algorithm illustrated in FIGS. 3 and 4 comprises two subalgorithms: subalgorithm 300 (FIG. 3) for timing the extraction of billets intended for the first strand 132; and subalgorithm 400 (FIG. 4) for timing the extraction of billets intended for the second strand 134. Each subalgorithm can be seen as a separate control process that can be performed semi-autonomously to control the pacing of billets for their respective strand. For the following it is assumed that the first billet extracted from the furnace 110 is provided to the first strand 132, the second billet to the second strand 134 and so on, alternating billets between the first strand 132 and the second strand 134. Additionally, the following exemplary subalgorithms 300, 400 represent algorithms to regulate the pacing of the furnace 110 in a system 100 utilizing a BDM 120 between the furnace 110 and the multistrand stand 130. In other embodiments, extracted billets are provided directly from the furnace 110 to the strands 132, 134 of the multistrand stand 130. In this case, the steps 304, 306, and 318 for subalgorithm 300 and steps 404, 406, and 418 for subalgorithm 400 may be omitted. Subalgorithm 300 initiates at step 302, whereupon a billet is extracted from the furnace 110. In the event that the billet is the first billet intended for the first strand 132 during a rolling operation, the extraction of the billet can be directed by the pacing control 140 without the use of the furnace timer 142. However, in the event that at least one billet was previously extracted for the first strand 132 during the rolling operation, the extraction of the billet in step 302, in one embodiment, is initiated as a result of the expiration of the furnace timer 142, as discussed in greater detail below with reference to step 326.

At step 304, the pacing control 140, in one embodiment, determines the potential for a collision between billets at the BDM 120 if and when the pacing control 140 extracts a billet for the second strand 134 at the expiration of the furnace timer 144 (step 402 of FIG. 4). In at least one embodiment, the minimum time and maximum time between the extractions of billets from the furnace 110 can be calculated using the following equations:

$$\text{MinTime_BDM} = \text{Rolling_Time}_{BDM} + Gap_{BDM} \qquad \text{EQ. 4}$$

$$\text{MaxTime_BDM} = \text{Furnace_Time}_{Strand1} - RollingTime_{BDM} - Gap_{BDM} \qquad \text{EQ. 5}$$

-continued $$\text{Rolling_Time}_{BDM} = \frac{BilletVolume_{Furnace}}{\text{BDM_Area} \times \text{BDM_Speed}} \quad \text{EQ. 6}$$

$$Gap_{BDM} = \frac{\text{Furnace_Time}_{Strand1} - 2 \times \text{Rolling_Time}_{BDM}}{2} \quad \text{EQ. 7}$$

where MinTime_BDM represents the minimum extraction time between the extraction of a second billet following the extraction of a first billet and MaxTime_BDM represents the maximum extraction time between the extraction of the first billet and the second billet without delaying a billet in one of the strands 132, 134. Rolling_Time$_{BDM}$ represents the predicted rolling time of the first billet by the BDM 120 and Gap$_{BDM}$ represents the optimal or desired gap between billets as they are provided to the BDM 120. BilletVolume$_{Furnace}$ represents the volume of the first billet out of the furnace 110, BDM_Area represents the cross-sectional area of the first billet as it exits the BDM 120, and BDM_Speed represents the exit speed of the billet from the BDM 120. Recall that Furnace_Time$_{Strand1}$ represents the initial time value of the furnace timer 142 set for the previously extracted billet provided to the first strand 132. The determination of Furnace_Time$_{Strand1}$ is discussed below with reference to step 310.

In order to detect a potential collision at step 304, the pacing control 140, in one embodiment, determines if the remaining time (Furnace_Timer$_{Strand2}$) on the furnace timer 144 is greater than or equal to MinTime_BDM, or:

$$\text{Furnace_Timer}_{Strand} \geq \text{MinTime_BDM} \quad \text{EQ. 8}$$

If Furnace_Timer$_{Strand2}$ is less than the MinTime_BDM, then furnace timer 144 is likely to expire while a previously extracted billet is still being rolled by the BDM 120, causing the furnace 110 to extract a billet for the second strand 134. In this case, the billet extracted for the second strand 134 would be provided to the BDM 120 while the BDM 120 is still rolling a previously extracted billet, likely resulting in a collision at the BDM 120. When Furnace_Time$_{Strand2}$ is determined to be less than MinTime_BDM the pacing control 140 increases the remaining time on the furnace timer 144 (i.e., Furnace_Timer$_{Strand2}$) to the minimum extraction time (MinTime_BDM) of the BDM 120, whereupon the furnace timer 144 continues to countdown using the updated remaining time (step 426, FIG. 4). By increasing the remaining time on the furnace timer 144 to the value of MinTime_BDM, the pacing control 140 can prevent a billet from being extracted from the furnace 110 and provided to the BDM 120 before the BDM 120 is finished with a previously extracted billet. After changing the value of Furnace_Timer$_{Strand2}$, if necessary, subalgorithm 300 proceeds to step 308.

At step 308, one or more properties of the billet extracted at step 302 are determined or obtained from the furnace control 138. These properties can include the weight of the billet, the length of the billet, the cross-sectional area of the billet, the volume of the billet, and the like. For example, the weight scale 112 of FIG. 1 can be used to determine the weight of the billet and/or a hot metal detector (one implementation of measuring device 114) can be used to determine the length of the billet, as discussed above. Likewise, in addition to the one or more measured properties of a billet, the pacing control 140/furnace control 138 can obtain one or more predetermined or fixed properties from a table, information provided by an operator, and the like. In general, these predetermined or fixed properties of the billet include properties that have little variance from billet to billet of the same type. For example, billets of a same type may have a cross-sectional area and/or density that vary insignificantly from billet to billet, if at all. Accordingly, such properties generally would not need to be measured for each billet, and instead a fixed value can be used for all billets of the same type.

To illustrate, the furnace control 138 can have access to a table or database having entries corresponding to one or more different types of billets that can be extracted from the furnace 110, where each entry has one or more fixed or predetermined properties of the associated billet type, such as a fixed cross-sectional area, a fixed density, and the like. The pacing control 140 then can use the billet type to obtain the one or more corresponding predetermined or fixed properties associated with the billet type from the furnace control 138. Additionally, after measuring and/or referencing one or more varying properties of the billet, the furnace control 138 can be adapted to determine the volume of the billet from the one or more measured and/or fixed properties and provide the volume value to the pacing control 140 in step 308. As discussed above, the volume can be computed from a measured length and fixed cross-sectional area of the billet, from a measured weight and a fixed density of the billet, from a measured length and a measured cross-sectional area of the billet, and the like.

At step 310, in one embodiment, the pacing control 140 predicts the expected rolling time of the billet using EQ. 2, as described above. In the event that the billet is the first billet intended for the first strand 132 in the rolling operation, the initial furnace time of the furnace timer 142 can be set using the equation:

$$\text{Furnace_Time}_{Strand1} = \text{Rolling_Time}_{Strand1} + \text{Gap}_{Strand1} \quad \text{EQ. 9}$$

where Furnace_Time$_{Strand1}$ represents the initial furnace of the furnace timer 142 (as opposed to Furnace_Timer$_{Strand1}$, which represents the remaining time of the furnace timer 142 during a countdown by the furnace timer 142), Rolling_Time$_{Strand1}$ represents the predicted rolling time of the billet, and Gap$_{Strand1}$ represents the desired or optimal gap between billets provided to the first strand 132. Profiles may be established including optimal gap ranges for billets of different types and/or different process dimensions and properties. The value of Gap$_{Strand1}$ can be determined through experimentation, calculation, and the like, and preferably is between about 0 seconds and about 60 seconds, more preferably is between about 1 second and about 30 seconds, and most preferably is between about 5 seconds and about 20 seconds. It will be appreciated that while the theoretical ideal gap would be 0 seconds, certain considerations, such as interstand tension and looper control and/or the capabilities of the furnace 110, typically must be taken into account. For example, the furnace 110 typically is loaded with 60 to 100 billets that take 1 to 2 hours to heat up. In the event that the furnace 110 cannot heat and output billets at a certain pace set by the pacing control 140, the pacing control 140 can adopt a longer gap time more suitable to the capabilities of the furnace 110.

In the event that a billet was previously extracted from the furnace 110 for rolling at the first strand 132 during the rolling operation, the initial time value of the furnace timer 142 can be set using the equation:

$$\text{Furnace_Time}_{Strand1} = \text{Rolling_Time}_{Strand1} + \text{Gap}_{Strand1} + \text{Cor}_{Strand1} \quad \text{EQ. 10}$$

where Cor$_{Strand1}$ represents a correction value based on an error between the predicted rolling time and the measured rolling time of the previously extracted billet. By adjusting the value of Furnace_Time$_{Strand1}$ by this correction value, the pacing control 140 can compensate for the error between the actual and predicted rolling time of the billets, thereby minimizing the deviation of the actual gap from the desired gap between billets. It will be appreciated that if the billet extracted in step 302 is the first billet to be extracted for the first strand 132 during a rolling cycle, the value of Cor$_{Strand1}$ would be zero, and this equation for Furnace_Time$_{Strand1}$ would reduce to the previous equation for Furnace_Time$_{Strand1}$.

Additionally, at step 310, the furnace timer 142, having an initial time value Furnace_Time$_{Strand1}$, is started and the countdown of the furnace timer continues at step 326. When a time period equivalent to Furnace_Time$_{Strand1}$ has expired (i.e., Furnace_Timer$_{Strand1}$=0), the pacing control 140 can direct the furnace 110 (via the furnace control 138) to extract the next billet intended for the first strand 132, as discussed below with reference to step 326.

At step 312, the pacing control 140 determines if there is potential for a collision between the extracted billet and a previously extracted billet at the first strand 132 by comparing the predicted remaining rolling time for the previously extracted billet provided to the first strand 132 with an estimate of the amount of time it will take for the extracted billet to reach the first strand 132. This estimate, in one embodiment, includes a measure of the time used by the previously extracted billet to reach the first strand 132 (i.e. the Measured_Time$_{BDM_Strand1}$ for the previously extracted billet). The remaining rolling time of the previously extracted billet can be estimated using the equation:

$$\text{Rolling_Time}_{left,Strand1}=\text{Rolling_Time}_{Strand1}+\text{Cor}_{Strand1}-\text{Current_Time}_{Strand1} \quad \text{EQ. 11}$$

where Rolling_Time$_{left,Strand1}$ represents the estimated remaining rolling time for the previously extracted billet, Rolling_Time$_{Strand1}$ represents the predicted rolling time of the billet determined at step 310, and Cor$_{Strand1}$ represents a previous correction value used to adjust the furnace time of the previously extracted billet that was determined in a previous iteration of the subalgorithm 300 (if any). Current_Time$_{Strand1}$ represents the amount of time that the previously extracted billet has been at the first strand 132 as of the time that this value is checked by the furnace 110 at step 312. Current_Time$_{Strant1}$ can be determined from the current time value of the rolling timer 146 associated with the previously extracted billet. To illustrate, when head of the previously extracted billet exited the first strand 132, the rolling timer 146 of the previously extracted billet was started. At any point in time after this, the time value of the rolling timer 146 represents the amount of time that the previously extracted billet has been in the first strand 132 up to that point in time (i.e., Current_Time$_{Strand1}$). The pacing control 140 can obtain this value from a rolling timer 146 associated with the previously extracted billet and use this value to calculate the remaining rolling time for the previously extracted billet using EQ. 11 above.

In the event that the remaining rolling time of the previously extracted billet is greater than the time it took for the head of the previously extracted billet to travel from the entrance of the BDM 120 to the exit of the first strand 132, a collision between the extracted billet and the previously extracted billet is likely since the extracted billet probably would arrive at the first strand 132 before the first strand 132 is finished processing the previously extracted billet. If there is a potential for collision, at step 314, the pacing control 140 directs the system 100 to hold the extracted billet at the entrance of the BDM 120 and pause the furnace timer 142 at step 314 until the following condition is met:

$$\text{Rolling_Time}_{left,Strand1}<\text{Measured_Time}_{BDM_Strand1}+\text{Adj} \quad \text{EQ. 12}$$

where Rolling_Time$_{left,Strand1}$ represents the estimated remaining rolling time for the previously extracted billet (as discussed above) and Measured_Time$_{BDM_Strand1}$ represents the measured time from when the head of the previously extracted billet enters the BDM 120 to when the head of the previously extracted billet exits the first strand 132. The pacing control 140 can measure Measured_Time$_{BDM_Strand1}$ using any of a variety of methods, as discussed above with reference to FIG. 2. Adj represents the minimum gap time required by the mill sequencing constraints described above, and preferably is not greater than this minimum so that the held bar does not cool down too much. Adj preferably is between about 0 seconds and about 20 seconds and more preferably about 5 seconds.

When the remaining rolling time of the previously extracted billet (Rolling_Time$_{left,Strand1}$) is less than a sum of the time used by the previously extracted billet to travel from the BDM 120 to the first strand 132 (Measured_Time$_{BDM_Strand1}$) and the cushion factor Adj, the pacing control 140 can safely assume that the first strand 132 would be finished with the previously extracted billet before the billet extracted at step 302 would reach the entrance to the first strand 132. Accordingly, once the condition is met, the extracted billet is provided to the BDM 120 for rolling at step 316. At step 318, the BDM rolling timer 150, representing the rolling time between when the head of a billet enters the BDM 120 to when the head of the corresponding bar exits the first strand 132, is started and the pacing control 140 begins the process of measuring Measured_Time$_{BDM_Strand1}$ for the extracted billet. As discussed above, any number of mechanisms may be used to detect the head of the extracted billet as it approaches the entrance of the BDM 120, such as by using a hot metal detector (HMD), a contact switch, a motion sensor, and the like.

The BDM 120 rolls the extracted billet into a bar and provides the bar to the first strand 132 of the multistrand stand 130 for additional rolling. The first strand 132 rolls the bar and as the resulting bar emerges from the exit of the first strand 132, a sensor, such as the hot metal detector 212 of FIG. 2, detects the head of the bar and sends a signal indicating such to the pacing control 140 at step 320. After the first stand 132 is finished rolling the bar, the tail end of the bar passes by the sensor, and the sensor provides a signal to the pacing control 140 indicating that the bar has exited the first strand 132 at step 322. Based on the input from the sensor (or the lack thereof), the pacing control 140 then can stop the BDM rolling timer 150 and the strand rolling timer 146. After the bar exits the first strand 132, the bar can be provided to another mill for additional rolling, removed from the rolling sequence for distribution, and the like.

At step 324, the measured rolling time of the extracted billet (Measured_Time$_{Strand1}$) at the first strand 132, represented by the elapsed time recorded by the strand rolling timer 146, is compared with the predicted rolling time (Rolling_Time$_{Strand1}$), and based on this comparison, a correction value Cor$_{Strand1}$ is determined, the correction value representing an error between the predicted rolling time and the actual or measured rolling time. In at least one embodiment, the correction value Cor$_{Strand1}$ is calculated using the equation:

$$\text{Cor}_n=\text{Cor}_{n-1}+(\text{Measured_Time}_{Strand1}-\text{Rolling_Time}_{Strand1}-\text{Cor}_{n-1})*k \quad \text{EQ. 13}$$

where $Cor_n$ represents the correction value used to adjust the furnace time for the next billet extraction for the first strand 132, $Cor_{n-1}$ represents the previous correction value calculated for a previously extracted billet intended for the first strand 132, $Measured_Time_{Strand1}$ represents the measured rolling time and $Rolling_Time_{Strand1}$ represents the predicted rolling time of the billet extracted at step 302. The constant k represents an adjustment factor used to optimize the calculation of $Cor_n$. The value of k can be determined empirically, by calculation, randomly, and the like. For example, the value of k can be adjusted during mill operation until a value for k is obtained that provides a consistent gap time as quickly as possible after starting up the mill. In one embodiment, the value of k is preferably between about 0 and about 1 and more preferably between about 0.4 and about 0.8.

Although an exemplary calculation of the correction value has been illustrated, other calculations of the correction value may be implemented as appropriate in accordance with at least one embodiment of the present invention. For example, the correction value $Cor_{Strand1}$ can be derived from a calculation as simple as subtracting the predicted rolling time of a billet from the measured rolling time. Those skilled in the art can develop alternate calculations for the correction value using the guidelines provided herein.

After the correction value $Cor_{Strand1}$ is determined in step 324, the correction value is stored by the pacing control 140. During the next iteration of subalgorithm 300 for the next billet intended for the first strand 132, the pacing control 140 uses the correction value from the previous iteration of the subalgorithm 300 to adjust the furnace time ($Furnace_Time_{Strand1}$) of the furnace timer 142 for the next billet. As such, the correction value can be viewed as an adjustment intended to compensate for the variation between the predicted rolling time of a billet and the actual rolling time, where the adjustment is based at least in part on a previous error between the predicted and measured rolling times of a previously extracted billet provided to the first strand 132. The variation between the predicted and measured rolling times can occur due to: slippage of the rollers within the BDM 120 and the multistrand stand 130; temperature variability, which affects length calculation; error between the estimated and actual stand speed; and the like.

At step 326, the current iteration of the subalgorithm 300 terminates and the furnace timer 142 continues its countdown until the furnace timer 142 expires (i.e., $Furnace_Timer_{Strand1}=0$). Upon the expiration of the furnace timer 142, the pacing control 140 directs the extraction of another billet that is intended for the first strand 132 at step 302 of the next iteration of the subalgorithm 300. In this way, subalgorithm 300 is repeated for one or more iterations to provide billets to the first strand 132 at a regulated pace.

Subalgorithm 400 of FIG. 4 represents subalgorithm 300 as applied to the pacing of billets for the second strand 134. As with step 302, at step 402 of subalgorithm 400, the pacing control 140, via the furnace control 138, directs the furnace 110 to extract a billet for the second strand 134. If this is the first billet extracted for the second strand 134 during a rolling operation, the pacing control 140 directs the furnace 110 to extract the billet after the extraction of the first billet intended for the first strand 132. In at least one embodiment, the first billet for the second strand 134 is extracted in a time period after the extraction of the first billet for the first strand 132, the time period being sometime between MinTime_BDM and MaxTime_BDM in length. Accordingly, by extracting the first billet for the second strand 134 after MinTime_BDM, a collision between the extracted billet and a previously extracted billet most likely can be avoided. Similarly, by extracting the first billet for the second strand 134 before MaxTime_BDM, the next billet for the second strand 134 is not unnecessarily delayed.

If a billet has previously been extracted for the second strand 134, the pacing control 140 times the extraction of the next billet for the second strand 134 based on the furnace timer 144. When the furnace timer 144 expires, the pacing control 140 directs the furnace control 138 to initiate the extraction of the billet for the second strand 134. At step 404, the pacing control 140 determines the potential for a collision between the extracted billet and a previously extracted billet at the BDM 120. In order to detect a potential collision at step 404, the pacing control 140, in one embodiment, determines if the remaining time ($Furnace_Timer_{Strand1}$) on the furnace timer 142 associated with the first strand 132 is greater than or equal to MinTime_BDM, or:

$$Furnace_Timer_{Strand1} \geq MinTime_BDM \qquad \text{EQ. 14}$$

If $Furnace_Timer_{Strand1}$ is less than the MinTime_BDM, then furnace timer 142 could expire while a previously extracted billet is still being rolled by the BDM 120, causing the furnace 110 to extract a billet for the first strand 132 and to provide the billet to the BDM 120 while the BDM 120 is still rolling the billet intended for the second strand 134. If a billet is provided to the BDM 120 while the BDM 120 is rolling a previously extracted billet, a collision between the two billets at the BDM 120 is probable. If $Furnace_Time_{Strand2}$ is determined to be less than MinTime_BDM, then the pacing control 140 increases the remaining time on the furnace timer 142 (i.e., $Furnace_Timer_{Strand1}$) to at least the value of MinTime_BDM at step 406 to minimize or eliminate the potential for a collision between billets due to a premature extraction of a billet, whereupon the furnace timer 142 continues to time the extraction of a billet from the furnace using the increased timer value at step 326 (FIG. 3).

As with step 308, one or more properties of the extracted billet, such as length, temperature, and/or weight, are measured and/or obtained at step 408 by the furnace control 138 and provided to the pacing control 140. After obtaining one or more properties of the billet, the pacing control 140 determines the volume of the billet from the one or more properties of the billet in step 408.

At step 410, in one embodiment, the pacing control 140 predicts the predicted rolling time of the billet using the equation:

$$Rolling_Time_{Strand2} = \frac{BilletVolume}{STD2_Area \times STD2_Speed} \qquad \text{EQ. 15}$$

where $Rolling_Time_{Strand2}$ represents the predicted rolling time for the billet at the second strand 134, BilletVolume is the measured Volume of the billet, STD2_Area represents the cross-sectional area of the bar produced from the extracted billet that is output by the second strand 134, and STD2_Speed represents the exit speed at which the bar is output by the second strand 134.

In the event that the billet is the first billet intended for the second strand 134 in the rolling operation, the time value of the furnace timer 144, can be set using the equation:

$$Furnace_Time_{Strand2} = Rolling_Time_{Strand2} + Gap_{Strand2} \qquad \text{EQ. 16}$$

where $Furnace_Tim_{Strand2}$ represents the initial time value of the furnace timer 144, as opposed to $Furnace_Timer_{Strand2}$, which represents the remaining time of the furnace timer 144 during a countdown by the furnace timer 144. Rolling_Time$_{Strand2}$ represents the predicted rolling time of the billet at the second strand 134, and Gap$_{Strand2}$ represents the desired or optimal gap between billets provided to the second strand 134. The value of Gap$_{Strand2}$ can be determined through experimentation, calculation, and the like, and preferably is between about 0 seconds and about 60 seconds, more preferably is between about 1 second and about 30 seconds, and most preferably is between about 5 seconds and about 20 seconds. In at least one embodiment, Gap$_{Strand1}$ and Gap$_{Strand2}$ are substantially equivalent.

In the event that a billet was previously extracted from the furnace 110 for rolling at the second strand 134, the initial time value of the furnace timer 144 can be set using the equation:

$$\text{Furnace_Time}_{Strand2}=\text{Rolling_Time}_{Strand2}+\text{Gap}_{Strand2}+\text{Cor}_{Strand2} \quad \text{EQ. 17}$$

where Cor$_{Strand2}$ represents a correction value based in part on a difference between the predicted rolling time and the measured rolling time of the previously extracted billet. It will be appreciated that if the billet extracted in step 402 were the first billet to be extracted for the second strand 134 during the rolling operation, the value of Cor$_{Strand2}$ would be zero.

Additionally, at step 410, the furnace timer 144, having an initial time value Furnace_Time$_{Strand2}$, is started and the countdown of the furnace timer continues at step 426. When a time period equivalent to Furnace_Time$_{Strand2}$ has expired (i.e., Furnace_Timer$_{Strand2}$=0), the pacing control 140 can direct the furnace control 138 to initiate the extraction of the next billet intended for the second strand 134 from the furnace 110, as discussed below with reference to step 426.

As with step 312, at step 412, the pacing control 140 determines if there is potential for a collision between the extracted billet and a previously extracted billet at the second strand 134 by comparing the predicted remaining rolling time for the previously extracted billet provided to the second strand 134 and an estimate of the amount of time it will take for the extracted billet to reach the second strand 134. As with subalgorithm 300, the remaining rolling time for the previously extracted billet at the second strand 134 can be predicted using the equation:

$$\text{Furnace_Time}_{left,Strand2}=\text{Rolling_Time}_{Strand2}+\text{Cor}_{Strand2}-\text{Current_Time}_{Strand2} \quad \text{EQ. 18}$$

where Rolling_Time$_{left,Strand2}$ represents the estimated remaining rolling time for the previously extracted billet at the second strand 134, Rolling_Time$_{Strand2}$ represents the predicted rolling time of the previously extracted billet, and Cor$_{Strand2}$ represents the correction value used to adjust the timing of the furnace timer 144 at step 410. Current_Time$_{Strand2}$ represents the amount of time that the previously extracted billet has been at the second strand 134 as of the time that this value is checked by the furnace 110 at step 412. Current_Time$_{Strant2}$ can be determined from the current time value of the rolling timer 148 associated with the previously extracted billet.

In the event that the remaining rolling time of the previously extracted billet is greater than the time it took for the head of the previously extracted billet to travel from the entrance of the BDM 120 to the exit of the second strand 134, then a collision between the extracted billet and the previously extracted billet is likely since the extracted billet likely would arrive at the second strand 134 before the second strand 134 is finished processing the previously extracted billet. If there is a potential for a collision, at step 414, the pacing control 140 directs the BDM 120 to hold the extracted billet at the entrance of the BDM 120 and pause the furnace timer 144 (step 426) until the following condition is met:

$$\text{Rolling_Time}_{left,Strand2}<\text{Measured_Time}_{BDM_Strand2}+\text{Adj} \quad \text{EQ. 19}$$

where Rolling_Time$_{left,Strand2}$ represents the predicted remaining rolling time for the previously extracted billet (as discussed above) and Measured_Time$_{BDM_Strand2}$ represents the measured time from when the head of the previously extracted billet enters the BDM 120 to when the head of the previously extracted billet exits the second strand 134. The pacing control 140 can measure Measured_Time$_{BDM_Strand2}$ using any of a variety of methods, as discussed above with reference to FIG. 2. As discussed above, Adj represents the minimum gap time required by the mill sequencing constraints.

When the remaining rolling time of the previously extracted billet (Rolling_Time$_{left,Strand2}$) is less than the time used by the previously extracted billet to travel from the BDM 120 to the second strand 134 (Measured_Time$_{BDM_Strand2}$) plus the cushion factor Adj, the pacing control 140 can safely assume that the second strand 134 would finish rolling the previously extracted billet before the billet extracted at step 402 would reach the entrance to the second strand 134. Accordingly, once the condition is met, the extracted billet is provided to the BDM 120 for rolling into a bar at step 416.

At step 418, the BDM rolling timer 152, representing the rolling time between when the head of a billet enters the BDM 120 to when the head of the corresponding bar exits the second strand 134, is started and the pacing control 140 begins the process of measuring Measured_Time$_{BDM_Strand2}$ for the extracted billet.

The BDM 120 rolls the extracted billet into a bar and provides the bar to the second strand 134 of the multistrand stand 130 for additional rolling. The second strand 134 rolls the bar into a bar and as the bar emerges from the exit of the second strand 134 a sensor detects the head of the bar and sends a signal indicating such to the pacing control 140 at step 420. At step 420, the pacing control 140 starts the strand rolling timer 148 associated with the extracted billet. After the second stand 134 is finished rolling the bar into a bar, the tail end of the bar passes by the sensor, and the sensor indicates to the pacing control 140 that bar has exited the second strand 134 at step 422. Based on the input from the sensor (or the lack thereof), the pacing control 140 then can stop the BDM rolling timer 152 and the strand rolling timer 148.

At step 424, the measured rolling time of the extracted billet (Measured_Time$_{Strand2}$), represented by the elapsed time recorded by the strand rolling timer 148, is compared with the predicted rolling time (Rolling_Time$_{Strand2}$), and based on this comparison, a correction value Cor$_{Strand2}$ is determined, the correction value representing an error between the predicted rolling time and the actual or measured rolling time. In at least one embodiment, the correction value Cor$_{Strand2}$ is calculated using the equation:

$$\text{Cor}_n=\text{Cor}_{n-1}+(\text{Measured_Time}_{Strand2}-\text{Rolling_Time}_{Strand2}-\text{Cor}_{n-1})*k \quad \text{EQ. 20}$$

where Cor$_n$ represents the correction value used to adjust the furnace timing for the next billet extraction for the second strand 134, Cor$_{n-1}$ represents the correction value calculated for a previously extracted billet intended for the second strand 134, Measured_Time$_{Strand2}$ represents the measured rolling time of the billet extracted at step 402, Rolling_

$Time_{Strand2}$ represents the predicted rolling time of the extracted billet, and k represents the adjustment factor used to optimize the calculation of $Cor_n$. Although an exemplary calculation of the correction value has been illustrated, other calculations of the correction value may be implemented by those skilled in the art in accordance with various embodiments of the present invention.

After the correction value $Cor_{Strand2}$ is determined in step 424, the correction value is stored by the pacing control 140. During the next iteration of subalgorithm 400 for the next billet intended for the second strand 134, the pacing control 140 uses the correction value from a previous iteration of the subalgorithm 400 to adjust the furnace time ($Furnace_Time_{Strand2}$) of the furnace timer 144 for the next billet.

As with step 326, at step 426, the current iteration of the subalgorithm 400 terminates and the furnace timer 144 continues its countdown until the furnace timer 144 expires (i.e., $Furnace_Timer_{Strand2}=0$) during step 426. Upon the expiration of the furnace timer 144, the pacing control 140 directs the extraction of the next billet intended for the second strand 134 at step 402 of a second iteration of the subalgorithm 400. In this way, subalgorithm 400 can be repeated for one or more iterations to provide billets to the second strand 134 at a regulated pace.

Subalgorithms 300 and 400 can be viewed as semi-autonomous algorithms where each subalgorithm independently directs the extraction of billets from the furnace 110 for their respective strand based at least in part on the predicted rolling time of the billets and correction values calculated from previous iterations of the subalgorithms. Each subalgorithm operates independently to regulate the gap between billets supplied to its respective strand, thereby improving the throughput of billets through the strands 132, 134 while decreasing the potential for collisions between billets. In general, the only interaction between the operations of the subalgorithms 300, 400, occurs at steps 304, 404, where the pacing control 140 determines the potential of a collision between at the BDM 120 based at least in part on the time remaining on one of furnace timers 142, 144 and the rolling time of the BDM 120 and at steps 306, 406 where the values of the timers 142, 144 are modified if a potential for a collision is predicted.

As described above, FIGS. 1 and 2 illustrate an exemplary system for pacing the extraction of billet from a furnace in a mill having two or more strands. Further, FIGS. 3–4 illustrate exemplary methods for implementing furnace pacing in the system illustrated in FIGS. 1 and 2 in accordance with at least one embodiment of the present invention. The hardware portions of the system 100 (FIG. 1), such as the furnace control 138 and the pacing control 140, may be in the form of a "processing device," such as a general purpose computer or programmable logic controller, for example. As used herein, the term "processing device" is to be understood to include at least one processor that uses at least one memory. The at least one memory stores a set of instructions. The instructions may be either permanently or temporarily stored in the memory or memories of the processing device. The processor executes the instructions that are stored in the memory or memories in order to process data. The set of instructions may include various instructions that perform a particular task or tasks, such as those tasks described above in the flowcharts. Such a set of instructions for performing a particular task may be characterized as a program, software program, or simply software.

The processing device typically executes the instructions that are stored in the memory or memories to process data. This processing of data may be in response to commands by a user or users of the processing device, in response to previous processing, in response to a request by another processing device and/or any other input.

The processing device used to implement at least one embodiment of the present invention may be a general purpose computer. However, the processing device described above may also utilize any of a wide variety of other technologies including a special purpose computer, a computer system including a microcomputer, mini-computer or mainframe for example, a programmed microprocessor, a micro-controller, a peripheral integrated circuit element, a CSIC (Customer Specific Integrated Circuit) or ASIC (Application Specific Integrated Circuit) or other integrated circuit, a logic circuit, a digital signal processor, a programmable logic device such as a FPGA, PLD, PLA or PAL, and the like.

As described above, a set of instructions may be used in the implementation of various embodiments of the present invention. The set of instructions may be in the form of a program or software. The software may be in the form of, for example, system software or application software. The software might also be in the form of a collection of separate programs, a program module within a larger program, or a portion of a program module. The software used might also include modular programming in the form of object-oriented programming. The software manipulates the processing device perform certain steps on the data being processed.

Further, it is appreciated that the instructions or set of instructions used in the implementation and operation of various embodiments of the present invention may be in a suitable form such that the processing device may read the instructions. For example, the instructions that form a program may be in the form of a suitable programming language, which is converted to machine language or object code to allow the processor or processors to read the instructions. That is, written lines of programming code or source code, in a particular programming language, are converted to machine language using a compiler, assembler or interpreter. The machine language is binary coded machine instructions that are specific to a particular type of processing device, i.e., to a particular type of computer, for example. The computer understands the machine language.

Any suitable programming language may be used in accordance with the various embodiments of the invention. Illustratively, the programming language used may include assembly language, Ada, APL, Basic, C, C++, COBOL, dBase, Forth, Fortran, Java, Modula-2, Pascal, Prolog, REXX, Visual Basic, and/or JavaScript, for example. Further, it is not necessary that a single type of instructions or single programming language be utilized. Rather, any number of different programming languages may be utilized as is necessary or desirable.

As described above, at least one embodiment of the present invention may illustratively be embodied in the form of a processing device, including a computer or computer system, for example, that includes at least one memory. It is to be appreciated that the set of instructions, i.e., the software for example, that enables the computer operating system to perform the operations described above may be contained on any of a wide variety of media or medium, as desired. Further, the data that is processed by the set of instructions might also be contained on any of a wide variety of media or medium. That is, the particular medium, i.e., the memory in the processing device, utilized to hold the set of instructions and/or the data may take on any of a variety of physical forms or transmissions, for example. Illustratively, the medium may be in the form of paper, paper transparencies, a compact disk, a DVD, an integrated circuit, a hard disk, a floppy disk, an optical disk, a magnetic tape, a RAM, a ROM, a PROM, an EPROM, a wire, a cable, a fiber, communications channel, a satellite transmissions or other remote transmission, as well as any other medium or source of data that may be read by the processors.

Further, the memory or memories used in the processing device may be in any of a wide variety of forms to allow the memory to hold instructions, data, or other information, as is desired. Thus, the memory might be in the form of a database to hold data. The database might use any desired arrangement of files such as a flat file arrangement or a relational database arrangement, for example.

Other embodiments, uses, and advantages of various embodiments of the present invention will be apparent to those skilled in the art from consideration of the specification and practice of the invention disclosed herein. The figures and the specification should be considered exemplary only, and the scope of the present invention is accordingly intended to be limited only by the following claims and equivalents thereof.

What is claimed is:

1. A method for pacing an extraction of billets from a furnace intended for a stand having at least one strand, the method comprising the steps of:

extracting a first billet from the furnace at a first time, the first billet being intended for a first strand of the stand;

predicting a rolling time of the first billet through the first strand based at least in part on at least one measured property of the first billet;

determining a first correction value based on an equation:

$$\mathrm{Cor}_n=\mathrm{Cor}_{n-1}+(\mathrm{Measured_Time}_{Strand1}-\mathrm{Rolling_Time}_{Strand1}-\mathrm{Cor}_{n-1})*k$$

where $\mathrm{Cor}_n$ represents the first correction value, $\mathrm{Cor}_{n-1}$ represents a previous correction value used to adjust a timing of an extraction of a previously extracted billet from the furnace intended for the first strand, $\mathrm{Measured_Time}_{Strand1}$ represents a measured rolling time of the previously extracted billet at the first strand, $\mathrm{Rolling_Time}_{Strand1}$ represents a predicted rolling time of the previously extracted billet at the first strand, and k represents a real-number adjustment factor;

determining a first furnace time based at least in part on the predicted rolling time of the first billet, a desired gap between billets at the first strand, and the correction value; and extracting a second billet from the furnace at a second time subsequent to the first time, the second billet being intended for the first strand, and wherein a difference between the first time and the second time is substantially equivalent to the first furnace time.

2. The method as in claim 1, wherein k is between 0 and 1.

3. The method as in claim 1, wherein k is essentially within a range of 0.4 to 0.8.

4. The method as in claim 1, further comprising the step of measuring a measured rolling time of the first billet at the first strand.

5. The method as in claim 1, wherein the step of predicting the predicted rolling time of the first billet includes predicting the predicted rolling time based on an equation:

$$\mathrm{Rolling_Time}_{Strand1}=\frac{BilletVolume}{\mathrm{STD1_Area}\times\mathrm{STD1_Speed}}$$

where $\mathrm{Rolling_Time}_{Strand1}$ represents the predicted rolling time of the first billet at the first strand, STD1_Area represents a cross-sectional area of the first billet at an output of the first strand, STD1_Speed represents an exit speed of the first billet from the first strand, and BilletVolume represents a calculated volume of the first billet.

6. The method as in claim 5, further including the step of calculating the calculated volume of the first billet based at least in part on the at least one measured property of the first billet.

7. The method as in claim 6, wherein the calculated volume of the first billet from the furnace is calculated from a volume of the first billet prior to heating by the furnace using an equation:

$$\mathrm{Billet_Volume}_{hot}=\mathrm{Billet_Volume}_{cold}\times\left[1+\left(C_1\times\left[\frac{TEMP-C_4}{C_2}\right]+C_3\times\left[\frac{TEMP-C_4}{C_2}\right]^2\right)\right]$$

where $\mathrm{Billet_Volume}_{hot}$ represents the volume of the first billet from the furnace, $\mathrm{Billet_Volume}_{cold}$ represents a volume of the first billet prior to heating in the furnace, TEMP represents a temperature of the first billet as discharged from the furnace, and $C_1$–$C_4$ represent constant-value temperature expansion adjustment factors associated with a material of the first billet.

8. The method as in claim 7, wherein the material of the billet is structural carbon steel and where $C_1$ is about 0.00675, $C_2$ is about 1000, $C_3$ is about 0.001636, and $C_4$ is about 32.

9. The method as in claim 6, wherein the at least one measured property of the first billet is one of a group consisting of: a weight of the first billet and a length of the first billet.

10. The method as in claim 6, wherein the calculated volume of the first billet is calculated based at least in part on the at least one measured property and at least one fixed property.

11. The method as in claim 10, wherein the at least one measured property includes a length of the first billet and the at least one fixed property includes a cross-sectional area of the first billet.

12. The method as in claim 10, wherein the at least one measured property includes a weight of the first billet and the at least one fixed property includes a density of the first billet.

13. The method as in claim 6, wherein the first billet is to be provided to a breakdown mill prior to being provided to the first strand, and wherein the breakdown mill is adapted to perform a head cut and a tail cut on the first billet.

14. The method as in claim 13, wherein the volume of the first billet is calculated based on an equation:

$$\mathrm{BilletVolume}=\mathrm{BilletVolume}_{Furnace}-\mathrm{BDM_Area}*(\mathrm{Headcut}+\mathrm{Tailcut})$$

where BilletVolume represents the volume of the first billet after the head cut and tail cut, $\mathrm{BilletVolume}_{Furnace}$ represents the volume of the first billet as extracted from the furnace, BDM_Area represents a cross-sectional area of the first billet as it is output from the breakdown mill, Headcut represents a longitudinal length of the head cut performed by the breakdown mill, and Tailcut represents a longitudinal length of the tail cut performed by the breakdown mill.

15. The method as in claim 1, further comprising the step of measuring the at least one measured property of the first billet.

16. The method as in claim 15, wherein the at least one measured property of the first billet includes one of a group consisting of: a weight of the first billet and a length of the first billet.

17. The method as in claim 1, wherein the step of determining the first furnace time includes determining the first furnace time based on an equation:

$$\text{Furnace_Time}_{Strand1}=\text{Rolling_Time}_{Strand1}+\text{Gap}_{Strand1}+\text{Cor}_{Strand1}$$

where $\text{Furnace_Time}_{Strand1}$ represents the first furnace time, $\text{Rolling_Time}_{Strand1}$ represents the predicted rolling time of the first billet, $\text{Cor}_{Strand1}$ represents the correction value, and $\text{Gap}_{Strand1}$ represents the desired gap between billets provided to the first strand.

18. The method as in claim 17, wherein the value of $\text{Gap}_{Strand1}$ is between 0 seconds and 60 seconds.

19. The method as in claim 17, wherein the value of $\text{Gap}_{Strand1}$ is essentially within a range of 5 seconds to 20 seconds.

20. The method as in claim 1, further including the steps of:

extracting a third billet from the furnace at a third time subsequent to the first time and prior to the second time, the third billet being intended for a second strand of the stand;

predicting a rolling time of the third billet at the second strand based at least in part on at least one measured property of the third billet;

determining a second correction value based on a equation:

$$\text{Cor}_n=\text{Cor}_{n-1}+(\text{Measured_Time}_{Strand2}-\text{Rolling_Time}_{Strand2}-\text{Cor}_{-1})*k$$

where $\text{Cor}_n$ represents the second correction value, $\text{Cor}_{-1}$ represents a previous correction value used to adjust a timing of an extraction of a previously extracted billet from the furnace intended for the second strand, $\text{Measured_Time}_{Strand2}$ represents a measured rolling time of the previously extracted billet at the second strand, $\text{Rolling_Time}_{Strand2}$ represents a predicted rolling time of the previously extracted billet at the second strand, and k represents the real-number adjustment factor;

determining a second furnace time based at least in part on the predicted rolling time of the third billet, a desired gap between billets at the second strand, and the second correction value; and extracting a fourth billet from the furnace at a fourth time subsequent to the second and third time, the fourth billet being intended for the second strand, and wherein a difference between the third time and the fourth time is substantially equivalent to the second furnace time.

21. The method as in claim 20, further including the step of providing each of the first, second, third, and fourth billets to a breakdown mill prior to providing each of the first and second billets to the first strand and the third and fourth billets to the second strand.

22. The method as in claim 21, wherein the step of extracting the third billet includes the steps of:

predicting a rolling time of the first billet at the breakdown mill;

predicting a minimum extraction time based at least in part on the predicted rolling time of the first billet at the breakdown mill, the predicted minimum extraction time representing a minimum time period between the first time and the third time, and wherein the minimum extraction time is equivalent to a sum of the predicted rolling time of the first billet at the breakdown mill and a desired gap between billets provided to the breakdown mill; and adjusting a difference between the first time and the third time to be at least as great as the minimum extraction time.

23. The method as in claim 22, further including determining the desired gap between billets provided to the breakdown mill based on an equation:

$$Gap_{BDM}=\frac{\text{Furnance_Time}_{Strand1}-2*\text{Rolling_Time}_{BDM}}{2}$$

where $\text{Gap}_{BMD}$ represents the desired gap, $\text{Furnace_Time}_{Strand1}$ represents the first furnace time, and $\text{Rolling_Time}_{BDM}$ represents the predicted rolling time of the first billet at the breakdown mill.

24. The method as in claim 21, further comprising the steps of:

predicting a rolling time of the second billet at the first strand based at least in part on at least one measured property of the second billet;

determining a third correction value based on an equation:

$$\text{Cor}_n=\text{Cor}_{n-1}+(\text{Measured_Time}_{Strand1}-\text{Rolling_Time}_{Strand1}-\text{Cor}_{n-1})*k$$

where $\text{Cor}_n$ represents the third correction value, $\text{Cor}_{n-1}$ represents the first correction value, $\text{Measured_Time}_{Strand1}$ represents the measured rolling time of the first billet at the first strand, $\text{Rolling_Time}_{Strand1}$ represents the predicted rolling time of the first billet at the first strand, and k represents the real-number adjustment factor;

determining a third furnace time based at least in part on the predicted rolling time of the second billet and the third correction value; and extracting a fifth billet from the furnace at a fifth time subsequent to the third time and the fourth time, the fifth billet being intended for the first strand, and wherein a difference between the second time and the fifth time is substantially equivalent to the third furnace time.

25. The method as in claim 24, wherein the step of determining the third furnace time includes the steps of:

predicting a rolling time of the fourth billet at the breakdown mill;

predicting a minimum extraction time based at least in part on the predicted rolling time of the fourth billet at the breakdown mill, the minimum extraction time representing a minimum time period between the fourth time and the fifth time, and wherein the minimum extraction time is equivalent to a sum of the predicted rolling time of the fourth billet at the breakdown mill and a desired gap between billets provided to the breakdown mill; and adjusting a difference between the fourth time and the fifth time to be at least as great as the minimum extraction time.

26. The method as in claim 21, wherein a difference between the first time and the third time is less than a maximum extraction time representing a maximum time period between the extraction of the first billet and the extraction of the third billet without causing a gap between the first billet and the second billet to exceed the desired gap between billets at the first strand.

27. The method as in claim 26, wherein the maximum extraction time is based on an equation:

$$\text{MaxTime_BDM}=\text{Furnace_Time}_{Strand1}-\text{RollingTime}_{BDM}-\text{Gap}_{BDM}$$

where MaxTime_BDM represents the maximum extraction time, $\text{Furnace_Time}_{Strand1}$ represents the first furnace time, $\text{RollingTime}_{BDM}$ represents a predicted rolling time of the first billet at the breakdown mill, and $\text{Gap}_{BDM}$ represents a desired gap between billets at the breakdown mill.

28. The method as in claim 1, wherein the first and second billets include steel billets.

29. A method for regulating gaps between billets provided from a furnace to alternating strands of a multistrand stand, the method comprising:

extracting a first billet from the furnace at a first time, the first billet being intended for a first strand of the stand;

extracting a second billet from the furnace at a second time subsequent to the first time, the second billet being intended for a second strand of the stand;

extracting a third billet from the furnace at a third time subsequent to the second time, the third billet being intended for the first strand;

extracting a fourth billet from the furnace at a fourth time subsequent to the third time, the fourth billet being intended for the second strand of the stand;

wherein a difference between the first time and the third time is based at least in part on a predicted rolling time of the first billet at the first strand, a desired gap between billets at the first strand, and a first correction value, where the predicted rolling time of the first billet is based at least in part on at least one measured property of the first billet;

wherein the first correction value is based at least in part on based on an equation:

$$\text{Cor}_n=\text{Cor}_{n-1}+(\text{Measured_Time}_{Strand1}-\text{Rolling_}_1\text{Time}_{Strand1}-\text{Cor}_{n-1})*k$$

where $\text{Cor}_n$ represents the first correction value, $\text{Cor}_{n-1}$ represents a previous correction value used to adjust a timing of an extraction of a previously extracted billet from the furnace intended for the first strand, $\text{Measured_Time}_{Strand1}$ represents a measured rolling time of the previously extracted billet at the first strand, $\text{Rolling_Time}_{Strand1}$ represents a predicted rolling time of the previously extracted billet at the first strand, and k represents a real-number adjustment factor;

wherein a difference between the second time and the fourth time is based at least in part on a predicted rolling time of the second billet at the second strand, a desired gap between billets at the second strand, and a second correction value, where the predicted rolling time of the second billet is based on at least one measured property of the second billet; and wherein the second correction value is based on an equation $$\text{Cor}_n=\text{Cor}_{n-1}+(\text{Measured_Time}_{Strand1}-\text{Rolling_Time}_{Strand1}-\text{Cor}_{n-1})*k$$

where $\text{Cor}_n$ represents the second correction value, $\text{Cor}_{n-1}$ represents a previous correction value used to adjust a timing of an extraction of a previously extracted billet from the furnace intended for the second strand, $\text{Measured_Time}_{Strand1}$ represents a measured rolling time of the previously extracted billet at the second strand, $\text{Rolling_Time}_{Strand1}$ represents a predicted rolling time of the previously extracted billet at the second strand, and k represents the real-number adjustment factor.

30. The method as in claim 29, wherein:

the predicted rolling time of the first previously extracted billet is based at least in part on at least one measured property of the first previously extracted billet; and the predicted rolling time of the second previously extracted billet is based at least in part on at least one measured property of the second previously extracted billet.

31. The method as in claim 30, wherein the at least one measured property of a billet is one of a group consisting of: a length of the billet and a weight of the billet.

32. The method as in claim 30, wherein the predicted rolling time of a billet is based at least in part on a measured volume of the billet from the furnace.

33. The method as in claim 32, wherein the measured volume of the billet from the furnace is calculated from a volume of the billet prior to heating by the furnace based on an equation:

$$\text{Billet_Volume}_{hot}=\text{Billet_Volume}_{cold}\times\left[1+\left(C_1\times\left[\frac{TEMP-C_4}{C_2}\right]+C_3\times\left[\frac{TEMP-C_4}{C_2}\right]^2\right)\right]$$

where $\text{Billet_Volume}_{hot}$ represents the volume of the billet from the furnace, $\text{Billet_Volume}_{cold}$ represents the volume of the billet prior to heating in the furnace, TEMP represents a temperature of the billet as discharged from the furnace, and $C_1$–$C_4$ represent constant-value temperature expansion adjustment factors associated with a material of the billet.

34. The method as in claim 29, wherein the first previously extracted billet is a first billet of a rolling operation to be provided to the first strand and the second previously extracted billet is a first billet of the rolling operation to be provided to the second strand.

35. The method as in claim 34, further comprising the steps of:

extracting the first previously extracted billet from the furnace at a fifth time prior to the first time;

extracting the second previously extracted billet from the furnace at a sixth time prior to the first time and subsequent to the fifth time;

wherein a difference between the fifth time and the first time is based at least in part on a sum of a predicted rolling time of the first previously extracted billet at the first strand and the desired gap between billets at the first strand; and wherein a difference between the sixth time and the second time is based at least in part on a sum of a predicted rolling time of the second previously extracted billet at the second strand and the desired gap between billets at the second strand.

36. The method as in claim 29, wherein k is between about 0.4 and about 0.8.

37. In a rolling system comprising a furnace for providing billets to a stand having at least one strand, an apparatus comprising:

means for obtaining measured property information representative of at least one measured property of a first billet extracted from the furnace at a first time and being intended for a first strand of the stand;

means for obtaining a measured rolling time of the first billet at the first strand; and a pacing control coupled to the means for obtaining the measured property information and the means for obtaining the measured rolling time, wherein the pacing control is adapted to:

predict a predicted rolling time of the first billet at the first strand based at least in part on the measured property information;

determine a correction value based at least in part on an equation:

$$Cor_n = Cor_{n-1} + (Measured_Time_{Strand1} - Rolling_Time_{Strand1} - Cor_{n-1}) * k$$

where $Cor_n$ represents the correction value, $Cor_{n-1}$ represents a previous correction value used to adjust a timing of an extraction of a previously extracted billet from the furnace intended for the first strand, $Measured_Time_{Strand1}$ represents a measured rolling time of the previously extracted billet at the first strand, $Rolling_Time_{Strand1}$ represents a predicted rolling time of the previously extracted billet at the first strand, and k represents a real-number adjustment factor; and direct an extraction of a second billet intended for the first strand at a second time subsequent to the first time, wherein a difference between the first time and the second time is based at least in part on a sum of a predicted rolling time of the second billet, the correction value, and a desired gap between billets at the first strand.

38. The apparatus as in claim 37, wherein the at least one measured property of the first billet includes a length of the first billet.

39. The apparatus as in claim 38, wherein the means for obtaining the measured property information include a hot metal detector being adapted to provide a first signal and a second signal to the pacing control, the first signal being representative of a head of the first billet approaching the hot metal detector and the second signal being representative of a tail of the first billet leaving the hot metal detector, and where a time difference between the first signal and a second signal is representative of a length of the first billet.

40. The apparatus as in claim 37, wherein the at least one measured property includes a weight of the first billet.

41. The apparatus as in claim 40, wherein the means for obtaining the measured property information includes a weight scale being adapted to measure the weight of the first billet extracted from the furnace and provide a signal representative of the weight of the billet to the pacing control.

42. The apparatus as in claim 37, wherein at least one measured property is representative of a volume of the first billet and where the predicted rolling time of the first billet is based at least in part on the volume of the first billet.

43. The apparatus as in claim 42, wherein the pacing control is further adapted to calculate the volume of the first billet from the furnace from a volume of the first billet prior to heating by the furnace based on an equation:

$$Billet_Volume_{hot} = Billet_Volume_{cold} \times \left[1 + \left(C_1 \times \left[\frac{TEMP - C_4}{C_2}\right] + C_3 \times \left[\frac{TEMP - C_4}{C_2}\right]^2\right)\right]$$

where $Billet_Volume_{hot}$ represents the volume of the first billet from the furnace, $Billet_Volume_{cold}$ represents a volume of the first billet prior to heating in the furnace, TEMP represents a temperature of the first billet as discharged from the furnace, and $C_1$–$C_4$ represent constant-value temperature expansion adjustment factors associated with a material of the first billet.

44. The apparatus as in claim 37, wherein the means for obtaining the measured rolling time of the first billet at the first stand include a hot metal detector located at an exit of the first strand and being adapted to provide a first signal and a second signal to the pacing control, the first signal being representative of a head of the billet approaching the hot metal detector and the second signal being representative of a tail of the billet leaving the hot metal detector, and wherein a time difference between first signal and the second signal is representative of the measured rolling time.

45. The apparatus as in claim 37, wherein the pacing control is adapted to predict the predicted rolling time of the first billet based at least in part on the equation:

$$Rolling_Time_{Strand1} = \frac{BilletVolume}{STD1_Area \times STD1_Speed}$$

where $Rolling_Time_{Strand1}$ represents the predicted rolling time of the first billet at the first strand, STD1_Area represents a cross-sectional area of the first billet at an exit of the first strand, STD1_Speed represents an exit speed of the first billet from the exit of the first strand, and BilletVolume represents a volume of the first billet calculated based at least in part on the at least one measured property of the first billet.

46. The apparatus as in claim 37, wherein the rolling system further comprises a breakdown mill between the furnace and the stand having the at least one strand, and where the difference between the first time and the second time further is based on a potential for a collision between the second billet and a billet previously extracted from the furnace at the breakdown mill.

47. The apparatus as in claim 37, further including:

means for obtaining measured property information representative of at least one measured property of the second billet; and wherein the pacing control further is adapted predict the predicted rolling time based at least in part on the measured property information of the second billet.

48. The apparatus as in claim 37, wherein the stand includes at least the first strand and a second strand, and where the billets are provided alternating respectively between the first strand and second strand.

49. The apparatus as in claim 48, wherein the pacing control further is adapted to direct an extraction of a third billet intended for the second strand at a third time subsequent to the first time and prior to the second time, and wherein a difference between the first time and the third time is based at least in part on predicted remaining rolling time of the first billet at a breakdown mill between the furnace and the first strand.

50. In a rolling system comprising a furnace for providing billets to a stand having at least one strand, a computer readable medium having a set of instructions adapted to manipulate a processor to:

predict a predicted rolling time of a first billet at a first strand based at least in part on a measured property of the billet;

determine a correction value based at least in part on an equation:

$$Cor_n = Cor_{n-1} + (Measured_Time_{Strand1} - Rolling_Time_{Strand1} - Cor_{n-1}) * k$$

where $Cor_n$ represents the correction value, $Cor_{n-1}$ represents a previous correction value used to adjust a timing of an extraction of a previously extracted billet from the furnace intended for the first strand, $Measured_Time_{Strand1}$ represents a measured rolling time of the previously extracted billet at the first strand, $Rolling_Time_{Strand1}$ represents a predicted rolling time of the previously extracted billet at the first strand, and k represents a real-number adjustment factor; and direct an extraction of a second billet intended for the first strand at a second time subsequent to the first time, wherein a difference between the first time and the second time is based at least in part on a sum of a predicted rolling time of the second billet, the correction value, and a desired gap between billets at the first strand.

51. The computer readable medium as in claim 50, wherein the at least one measured property of the first billet includes a length of the first billet.

52. The computer readable medium as in claim 50, wherein the at least one measured property includes a weight of the first billet.

53. The computer readable medium as in claim 50, wherein the set of instructions include instructions adapted to manipulate the processor to predict the predicted rolling time based at least in part on an equation:

$$\text{Rolling_Time}_{Strand1} = \frac{BilletVolume}{\text{STD1_Area} \times \text{STD1_Speed}}$$

where $Rolling_Time_{Strand1}$ represents the predicted rolling time of the first billet at the first strand, STD1_Area represents a cross-sectional area of the first billet at an exit of the first strand, STD1_Speed represents an exit speed of the first billet from the exit of the first strand, and BilletVolume represents a volume of the first billet calculated based at least in part on the at least one measured property of the first billet.

54. The computer readable medium as in claim 50, wherein the rolling system further comprises a breakdown mill between the furnace and the stand, and where the difference between the first time and the second time further is based on a potential for a collision between the second billet and a billet previously extracted from the furnace.

55. The computer readable medium as in claim 50, wherein the stand includes at least the first strand and a second strand, and where the billets are provided alternating between the first stand and second strand.

56. The computer readable medium as in claim 55, further including instructions being adapted to manipulate the processor to direct an extraction of a third billet intended for the second strand at a third time subsequent to the first time and prior to the second time, wherein a difference between the first time and the third time is based at least in part on predicted remaining rolling time of the first billet at a breakdown mill between the furnace and the first strand.

57. The computer readable medium as in claim 50, wherein the predicted rolling time of the first billet is based at least in part on a volume of the first billet from the furnace.

58. The computer readable medium as in claim 57, the set of instructions further including instructions adapted to manipulate the processor to calculate the volume of the first billet from the furnace from a volume of the first billet prior to heating by the furnace based on an equation:

$$\text{Billet_Volume}_{hot} = \text{Billet_Volume}_{cold} \times \left[1 + \left(C_1 \times \left[\frac{TEMP - C_4}{C_2}\right] + C_3 \times \left[\frac{TEMP - C_4}{C_2}\right]^2\right)\right]$$

where $Billet_Volume_{hot}$ represents the volume of the first billet from the furnace, $Billet_Volume_{cold}$ represents a volume of the first billet prior to heating in the furnace, TEMP represents a temperature of the first billet as discharged from the furnace, and $C_1$–$C_4$ represent constant-value temperature expansion adjustment factors associated with a material of the first billet.

* * * * *